US009905106B2

(12) United States Patent
Yang et al.

(10) Patent No.: US 9,905,106 B2
(45) Date of Patent: Feb. 27, 2018

(54) ERGONOMICS AWARENESS CHAIRS, SYSTEMS, AND METHODS

(71) Applicant: The Boeing Company, Chicago, IL (US)

(72) Inventors: Yueli Yang, Seattle, WA (US); Kiran Thomas, Snoqualmie, WA (US); Timothy Stumpf, Foristell, MO (US); Connie Starr, Seattle, WA (US); Quy V. Le, Seattle, WA (US); Amanda Elizabeth Johnson, Seattle, WA (US)

(73) Assignee: The Boeing Company, Chicago, IL (US)

( * ) Notice: Subject to any disclaimer, the term of this patent is extended or adjusted under 35 U.S.C. 154(b) by 109 days.

(21) Appl. No.: 14/866,569

(22) Filed: Sep. 25, 2015

(65) Prior Publication Data

US 2017/0092094 A1 Mar. 30, 2017

(51) Int. Cl.

| | |
|---|---|
| ***G08B 21/04*** | (2006.01) |
| ***A47C 7/00*** | (2006.01) |
| ***G08B 21/18*** | (2006.01) |
| ***A47C 7/72*** | (2006.01) |
| ***A47C 9/00*** | (2006.01) |

(52) U.S. Cl.

CPC ..... *G08B 21/0415* (2013.01); *A47C 7/72* (2013.01); *A47C 9/002* (2013.01); *G08B 21/0446* (2013.01); *G08B 21/182* (2013.01)

(58) Field of Classification Search

CPC ... A47C 7/00; G08B 21/0415; G08B 21/0446
See application file for complete search history.

(56) References Cited

U.S. PATENT DOCUMENTS

| | | | |
|---|---|---|---|
| 4,007,733 | A | 2/1977 | Celeste et al. |
| 6,669,286 | B2 | 12/2003 | Iusim |
| 6,673,027 | B2 | 1/2004 | Fischer |

(Continued)

OTHER PUBLICATIONS

T. Fredericks et al., "Influence of Armrest Width and Task on Armrest Usage," Proceedings of the 2014 Industrial and Systems Engineering Research Conference, Montréal, Canada, May 31-Jun. 3, 2014.

*Primary Examiner* — Sisay Yacob
(74) *Attorney, Agent, or Firm* — DASCENZO Intellectual Property Law, P.C.

(57) ABSTRACT

Ergonomics awareness chairs, systems, and methods are disclosed. Methods include reading sensor values from sensors in an ergonomics awareness chair, calculating a posture type based on the sensor values, determining a time the user has been continuously sitting properly, and, if the time is greater than a predetermined threshold time, alerting the user to take a break. Systems include a user-interface computer and an ergonomics awareness chair with a controller. The ergonomics awareness chair includes a shoulder sensor, a lumbar sensor, a buttocks sensor, a thigh sensor, and an armrest sensor in each of the armrests. The controller is configured to acquire sensor values from the sensors. The user-interface computer is programmed to determine at least two types of postures based on the sensor values. The types of postures may include sitting properly and sitting improperly (e.g., slouching, hunching, straining shoulders, leaning, sitting on edge, and crossing legs).

20 Claims, 13 Drawing Sheets

(56) References Cited

U.S. PATENT DOCUMENTS

| | | | | |
|---|---|---|---|---|
| 7,029,031 | B2 | 4/2006 | Moisel et al. | |
| 7,161,490 | B2 | 1/2007 | Huiban | |
| 7,471,290 | B2 | 12/2008 | Wang et al. | |
| 8,477,039 | B2 | 7/2013 | Gleckler et al. | |
| 9,044,172 | B2 * | 6/2015 | Baxi | A61B 5/1116 |
| 2002/0171272 | A1 * | 11/2002 | Iusim | A47C 9/002 297/217.4 |
| 2003/0001749 | A1 * | 1/2003 | Ishida | B60R 21/0155 340/667 |
| 2004/0056520 | A1 * | 3/2004 | Cho | A47C 7/405 297/218.1 |
| 2005/0006941 | A1 | 1/2005 | Park | |
| 2005/0067816 | A1 | 3/2005 | Buckman | |
| 2006/0175888 | A1 | 8/2006 | Droche | |
| 2008/0049020 | A1 | 2/2008 | Gusler et al. | |
| 2009/0058661 | A1 | 3/2009 | Gleckler et al. | |
| 2010/0045454 | A1 | 2/2010 | Knight et al. | |
| 2011/0080290 | A1 * | 4/2011 | Baxi | A61B 5/1116 340/573.1 |
| 2011/0275939 | A1 | 11/2011 | Walsh et al. | |
| 2015/0142381 | A1 * | 5/2015 | Fitzsimmons | A47C 7/006 702/166 |
| 2015/0366350 | A1 * | 12/2015 | Di Censo | A47C 1/00 700/275 |

* cited by examiner

ERGONOMICS AWARENESS CHAIRS, SYSTEMS, AND METHODS

FIELD

The present disclosure relates to ergonomics awareness chairs, systems, and methods.

BACKGROUND

Health issues related to sitting at a desk (generally musculoskeletal disorders) may be mitigated and/or avoided by proper design and use of the user's workstation. In particular, sitting posture is important to good health. Improving posture while seated may lead to increased comfort, increased user engagement, increased productivity, and decreased risk of musculoskeletal injury.

Even when an ergonomically adjustable chair is available and properly adjusted, users may inadvertently sit with poor posture, which may negate the benefits of the ergonomic design. Further, users may not recognize when they transition from a healthy posture to an unhealthy one. An ergonomically proper posture includes the buttocks supported at the back of the seat, with the hips, lumbar region, and shoulders supported against the backrest (or seatback), the thighs supported at the front of the seat, and the arms supported by armrests.

SUMMARY

Ergonomics awareness chairs, systems, and methods are disclosed. Methods include methods of promoting ergonomic posture of a user sitting in an ergonomics awareness chair. Methods include reading a first sensor value from a first sensor and a second sensor value from a second sensor, calculating a posture type based on the first sensor value and the second sensor value. The posture type may be one of improper sitting posture and proper sitting posture. Methods further include determining a time the user has been in a proper sitting posture and, if the time is greater than a predetermined threshold time, alerting the user to take a break. Methods include alerting the user when the posture type is sitting improperly. And, methods include repeating the reading, the calculating, the determining, and the alerting until the time is greater than the predetermined threshold time (e.g., a break interval).

Systems include a user-interface computer and an ergonomics awareness chair with a controller. The ergonomics awareness chair includes a shoulder sensor in the backrest of the chair, a lumbar sensor in the backrest, a buttocks sensor in the seat of the chair, a thigh sensor in the seat, and an armrest sensor in each of the armrests of the chair. The controller is configured to acquire sensor values from the sensors. The user-interface computer is programmed to display visual messages to the user of the ergonomics awareness chair. The user-interface computer is programmed to determine at least two types of postures, based on the sensor values. The types of postures may include sitting properly and sitting improperly (e.g., slouching, hunching, straining shoulders, leaning, sitting on edge, and crossing legs). The controller of the ergonomics awareness chair and the user-interface computer are configured to wirelessly communicate with each other.

DESCRIPTION

Figure 1:
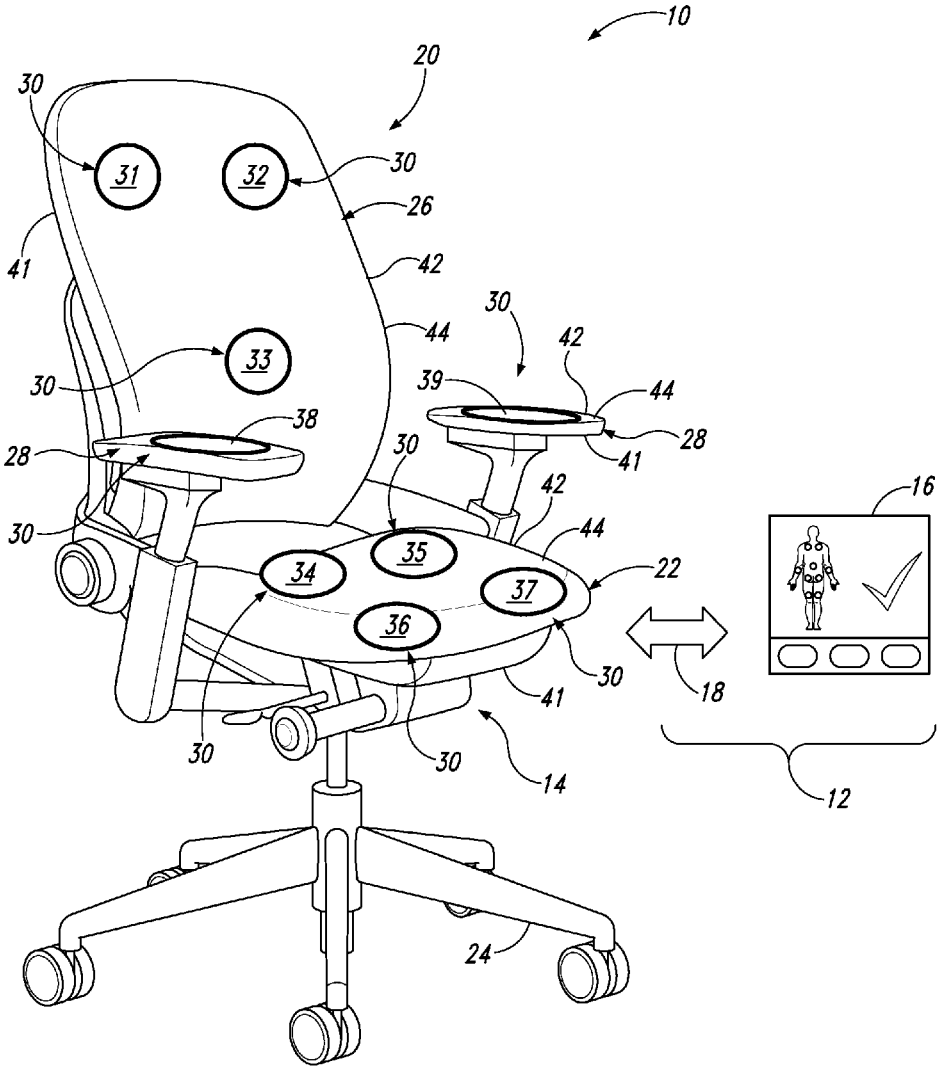
FIG. 1 is a schematic representation of an ergonomics awareness system according to the present disclosure.

FIGS. 1-14 illustrate ergonomics awareness chairs, systems, and methods. In general, in the drawings, elements that are likely to be included in a given embodiment are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. Elements that serve a similar, or at least substantially similar, purpose are labelled with numbers consistent among the figures. Like numbers in each of the figures, and the corresponding elements, may not be discussed in detail herein with reference to each of the figures. Similarly, all elements may not be labelled or shown in each of the figures, but reference numerals associated therewith may be used for consistency. Elements, components, and/or features that are discussed with reference to one or more of the figures may be included in and/or used with any of the figures without departing from the scope of the present disclosure.

As shown in the schematic representation of FIG. 1, a system 10 (also called an ergonomics awareness system) includes a chair 20 (also called an ergonomics awareness chair) and a control system 12. The chair 20 includes a group of sensors 30, configured to sense force from a user sitting on the chair, and a controller 14, configured to acquire sensor values from the sensors 30. The control system 12 includes the controller 14 and a user-interface computer 16 which are configured to wirelessly communicate with each other via a wireless communications link 18. The control system 12 is configured to determine the user's posture with the sensors 30 and to communicate posture information to the user.

The chair 20 includes a seat 22, a seat support 24, a backrest 26, and at least one (generally two) armrest 28 (e.g., a right armrest and a left armrest). Collectively, the seat 22, the backrest 26, and the armrest(s) 28 may be referred to as body supports. Though illustrated in FIG. 1 as a rolling office chair, chair 20 is not necessarily a rolling chair or an office chair. Chair 20 generally is adjustable to fit the body of the user. For example, the seat height, the seat tilt, the back tilt, the lumbar support, the armrest height, and/or the armrest spacing may be adjustable. Each of the body supports (i.e., the seat 22, the backrest 26, and the armrest(s) 28) has a resting surface 42 configured to contact the user. The resting surface 42 generally is a cloth, leather, and/or plastic surface. The resting surface 42 generally covers (and/or may be at least a portion of the outer surface of) one or more chair pads 44 that are configured to support the user's body. Chair pads 44 are coupled to and supported by one or more support frames 41. Chair pads 44 generally are compressible and resilient and may include, e.g., foam and/or batting.

Sensors 30 are arranged in the body supports (i.e., the seat 22, the backrest 26, and the armrest(s) 28) to sense and/or to detect the user sitting on and/or using the respective portion of the chair 20. When the user uses the chair 20, the user exerts a force on the chair 20 and the support elements such as the seat 22, the backrest 26, and/or the armrest(s) 28. Individual sensors 30 are in a respective body support. As used herein, a sensor 30 "in" a body support means that the sensor 30 is on or at the resting surface 42 of the body support, on or in the optional chair pad 44 of the body support (under the resting surface 42), or on the support frame 41 directly supporting the body support (under the resting surface 41 and optional chair pad 44).

The sensors 30 are electronic devices that each are configured to detect the force of a portion of the user's body when the chair 20 is in use. For example, the chair 20 may include one or more shoulder sensors (indicated at 31 and 32) to sense force from a user's shoulder, one or more lumbar sensors 33 to sense force from a user's lumbar region, one or more buttocks sensors (indicated at 34 and 35) to sense force from a user's buttocks, one or more thigh sensors (indicated at 36 and 37) to sense force from a user's thigh, and one or more armrest sensors (indicated at 38 and 39) to sense force from a user's arm.

The sensors 30 are distributed in the seat 22, the backrest 26, and the armrest(s) 28 to sense the corresponding body region force. The chair 20 generally includes at least one sensor 30 for each body region to be detected. The use of one sensor 30 for each body region may be more economically practical and may simplify data collection and interpretation. The chair 20 may include a group of two or at least two shoulder sensors, e.g., a right shoulder sensor 31 and a left shoulder sensor 32. The chair 20 may include a single lumbar sensor 33. The chair may include a group of two or at least two buttocks sensors, e.g., a right buttocks sensor 34 and a left buttocks sensor 35. The chair 20 may include a group of two or at least two thigh sensors, e.g., a right thigh sensor 36 and a left thigh sensor 37. The chair 20 may include a single armrest sensor in each armrest 28 and may include two or at least two armrest sensors, e.g., a single right armrest sensor 38 and a single left armrest sensor 39.

The sensors 30 are tactile sensors and may be configured to measure force, pressure, displacement, and/or touch (contact). Though sensors 30 may sense force, pressure, displacement, and/or touch across an area, sensors 30 generally are configured to register a single measured value for a particular applied force, pressure, displacement, and/or touch. Sensors 30 generally do not provide a map of forces, pressures, displacements, and/or touches over an active area. Suitable sensor devices include a force sensitive resistor, a piezoelectric sensor, and a button switch. The type of device for each sensor 30 may be selected independently and according to the particular location in the chair 20 and/or the body region to be sensed. All sensors 30 may be of the same type, all sensors in the same type of support element (seat 22, backrest 26, and armrest 28) may be the same type, and/or all corresponding sensors (e.g., both shoulder sensors) may be the same type. Examples include: (a) both the right shoulder sensor 31 and the left shoulder sensor 32 may be force sensitive resistors, (b) all of the backrest sensors (e.g., the right shoulder sensor 31, the left shoulder sensor 32, and the lumbar sensor 33) may be force sensitive resistors, (c) the right buttocks sensor 34 and the left buttocks sensor 35 may be piezoelectric sensors, (d) all of the seat sensors (e.g., the right buttocks sensor 34, the left buttocks sensor 35, the right thigh sensor 36, and the left thigh sensor 37) may be piezoelectric sensors, and/or (e) all of the armrest sensors (e.g., the right armrest sensor 38 and the left armrest sensor 39) may be force sensitive resistors.

Figure 2:
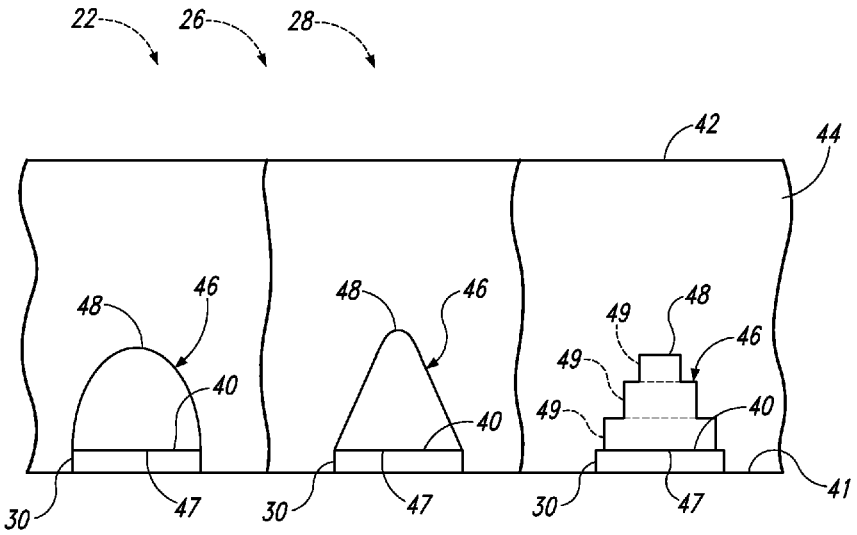
FIG. 2 is a schematic cross-sectional view of three examples of sensor configurations.

As schematically represented in FIG. 2, sensors 30 are located in the respective support element (seat 22, backrest 26, and armrest 28) and not at or on the resting surface 42. Sensors 30 are integrated into the chair 20 and are not merely an overlay, pad, or cover of the chair 20. Sensors 30 generally are located beneath or within the chair pad 44, beneath the resting surface 42. As used in this context, beneath refers to spaced away from the user by at least the resting surface 42. For example, sensors 30 in the backrest 26 that are beneath the resting surface 42 would be behind the user's back separated from the user by at least the resting surface 42. Each sensor 30 has a sensing surface 40 that is configured to sense the force, pressure, displacement, and/or touch of the user. The respective sensing surfaces 40 generally are located beneath the resting surface 42, beneath or within the chair pad 44. Sensors 30 may be supported by and/or directly contact the support frame 41.

Each sensor 30 independently may be coupled to a force enhancer 46. Force enhancers 46 are configured to transmit the user's body force(s) to the respective sensor 30, specifically to the sensing surface 40 of the sensor 30. In an embodiment with a force enhancer 46, a sensor 30 generally is coupled to a single force enhancer 46.

Force enhancers 46 may distribute the applied force, or related physical interaction, over a wider area (e.g., a focused force may be distributed over substantially the full surface area of the respective sensing surface 40). Force enhancers 46 may transfer the applied force, or related physical interaction, into a more suitable direction for sensing by the respective sensor 30. Force enhancers 46 may be compressible and/or resilient, and generally are less compressible and/or more resilient than the corresponding chair pad 44. For example, force enhancers 46 may include, and/or may be composed essentially of, plastic, rubber, and/or paper.

Force enhancers 46 have a base 47 that is coupled to, and generally contacts, the sensing surface 40 of the respective sensor 30 (e.g., the force enhancer 46 may be bonded to the sensing surface 40 with adhesive). Force enhancers 46 have an apex 48 that is opposite the base, and spaced away from the respective sensing surface 40. The area of the apex 48 is generally less than the area of the base 47 and the corresponding force enhancer 46 may be described as peaked and/or dome-shaped. The left example element of FIG. 2 illustrates a generally dome-shaped force enhancer 46. The center example element of FIG. 2 illustrates a generally peaked or conical force enhancer 46. Force enhancers 46 may have a polygonal base 47 and/or faces, and, hence, may be described as pyramidal. The right example element of FIG. 2 illustrates a stepped pyramidal force enhancer 46.

Force enhancers 46 may include several force enhancer elements 49 that are aligned and/or bonded together to form the force enhancer 46. As indicated in the right example of FIG. 2, the force enhancer elements 49 may be arranged as a stack. Each force enhancer element 49 may be composed of substantially the same material and/or may be substantially identical (e.g., in size and/or material). Individual force enhancer elements 46 may be selected and/or arranged to suitably distribute and/or transfer the applied forces, or related physical interactions, from the user to the respective sensing surface 40.

Figure 3:
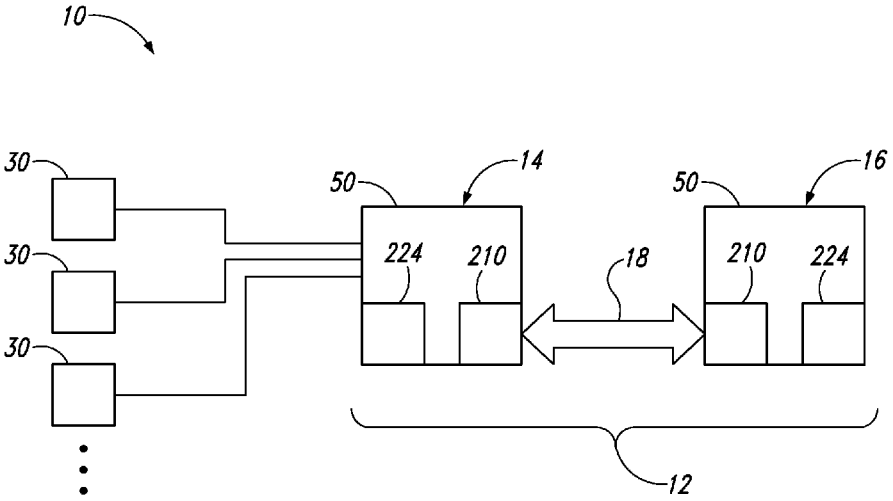
FIG. 3 is a schematic diagram of the interconnections of sensors, the controller, and the user-interface computer in an ergonomics awareness system according to the present disclosure.

As shown in FIG. 3, sensors 30 are electronically connected to control system 12. The control system 12 is configured, adapted, and/or programmed to collect sensor data from the sensors 30 and to provide posture information related to the sensor data to a user. Generally, the control system 12 may be configured to coordinate acquisition of sensor data, to communicate the sensor data, and/or related parameters, and/or to control the system 10 as a whole. As used herein, where the control system 12, the controller 14, and/or the user-interface computer 16 is configured, adapted, and/or programmed to perform a function, the configuration, adaptation, and/or programming may be in the form of hardware (e.g., wiring, digital logic chips), firmware (e.g., field-programmable gate array, embedded code), and/or software.

As noted, the control system 12 includes the controller 14 (a component of the chair 20) and the user-interface computer 16. The controller 14 and the user-interface computer 16 divide the tasks of the control system 12, with the controller 14 at least configured, adapted, and/or programmed to control the sensors 30 (e.g., controlling power and/or acquiring individual sensor values), and with the user-interface computer 16 at least configured, adapted, and/or programmed to display visual messages to the user of the chair 20. The user-interface computer 16 does not directly acquire the sensor values from the sensors 30. Other functions of the control system 12 may be performed by one or both of the controller 14 and the user-interface computer 16. For example, the controller 14 and the user-interface computer 16 may both store sensor data (individual sensor values). As another example, the controller 14 may include user interface elements such as lights or other indicators to signal the status of the controller 14, the sensors 30, and/or the wireless communications link 18.

The wireless communications link 18 between the controller 14 and the user-interface computer 16 may be a wireless link operating with one or more wireless protocols such as BLUETOOTH protocol and WI-FI protocol (e.g., compliant with IEEE 802.11 standards). Each of the controller 14 and the user-interface computer 16 includes a communications infrastructure 210 to communicate with each other (as described further herein).

Each of the controller 14 and the user-interface computer 16 may include a power source 224 (as described further herein). Additionally or alternatively, power may be provided to the controller 14 and/or the user-interface computer 16 via a wired and/or wireless connection. Controller 14 may include a power source 224 which is a battery that is configured to power the controller 14 and the sensors 30 (directly or indirectly).

The controller 14 is configured, adapted, and/or programmed to determine sensor data from the sensors 30 (e.g., to read and/or measure sensor values) and may be configured, adapted, and/or programmed to communicate at least some of the sensor data to the user-interface computer 16. Controllers 14 typically are computing devices and may be referred to as a microcontroller, an embedded controller, and/or an embedded system. Controllers 14 may be configured, adapted, and/or programmed to collect raw sensor values from the sensors 30, to filter and/or process the raw sensor values (e.g., suppress noise, time average), to store sensor values (raw and/or as processed), and/or to determine parameters related to the sensor values (e.g., posture classifications as described further herein).

The controller 14 may be configured, adapted, and/or programmed to acquire sensor values from the sensors 30 in essentially any order. The controller 14 may be configured, adapted, and/or programmed to acquire values from one or more sensors 30 at least partially simultaneously and/or at least partially sequentially. Sensor values may be acquired in batches with all sensors 30 read within a defined period of time appropriate to indicate posture changes to the user. For example, all sensors may be read within 5 seconds, 2 seconds, or 1 second. When all sensors are read within a suitably short time period, such as 5 seconds, 2 seconds, 1 second, or less than 1 second, the reading of the sensors 30 may be described as concurrent, even though the individual sensors 30 may be read at least partially sequentially or at different times within the time period.

The controller 14 may be configured, adapted, and/or programmed to acquire sensor values periodically, substantially periodically, or upon command from the user and/or the user-interface computer 16. The interval between sensor readings may be user-configurable and/or less than 1 second, about 1 second, about 2 seconds, about 5 seconds, about 10 seconds, or about one minute. The controller 14 may be configured, adapted, and/or programmed to acquire sensor values substantially continuously, optionally recording the time of the acquisition. The controller 14 may be configured, adapted, and/or programmed to acquire sensor data upon command from the user, at a predetermined time, and/or when one or more of the sensor values, or related parameter, meets a predetermined threshold.

Though the control system 12 may control the system 10 generally, the user may have ultimate control of the system 10. For example, the user may initiate, pause, and/or terminate the acquisition of sensor data from one or more of the sensors 30. Parameters associated with the control system 12, the controller 14, the user-interface computer 16, and/or modules 50 (as described further herein) may be user configurable and/or responsive to user inputs. For example, the user may specify, select, and/or adjust the sensor reading interval, which sensors to read, sensor offsets, sensor calibrations, sensor activity thresholds, and/or what sensor-related data to log.

The user-interface computer 16 may be a workstation computer, a portable computer (e.g., a laptop computer, a notebook computer, a tablet computer), a wearable computer, a hand-held computer, and/or a mobile computing device (e.g., a smartphone). The user-interface computer 16 and the chair 20 may be part of the same user workstation.

Figure 4:
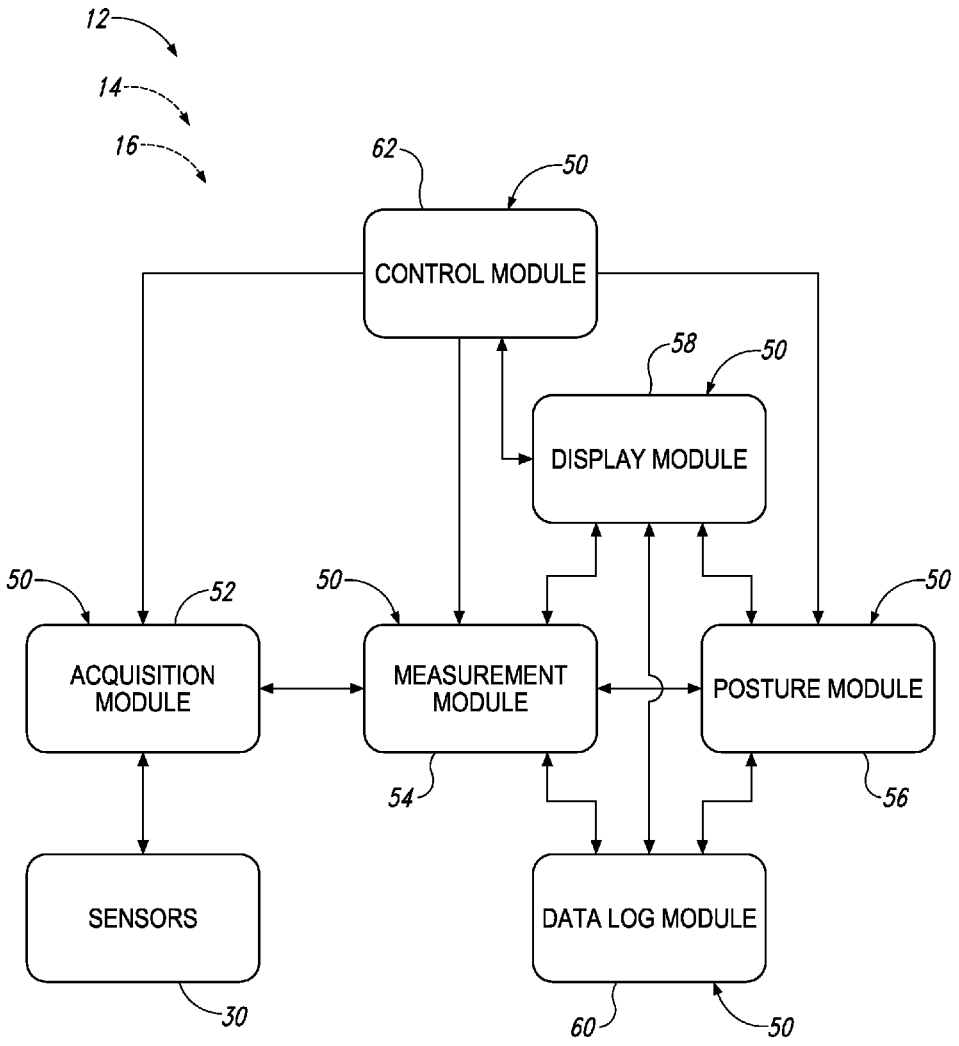
FIG. 4 is a schematic diagram of modules in a control system.

Processing functions of the controller 14 and/or the user-interface computer 16 may be described as modules 50. As schematically represented in FIG. 4, control system 12, controller 14, and/or user-interface computer 16 may include several modules 50. These modules 50 (which also may be referred to as agents, programs, processes, and/or procedures) may include an acquisition module 52, a measurement module 54, a posture module 56, a display module 58, a data log module 60 and/or a control module 62.

The acquisition module 52 is instantiated and/or implemented, at least in part, in the controller 14. The display module 58 is instantiated and/or implemented, at least in part, in the user-interface computer 16. The other modules 50 may be instantiated and/or implemented in one or both of the controller 14 and the user-interface computer 16. Where a module 50 is instantiated and/or implemented in both of the controller 14 and the user-interface computer 16, the controller 14 and the user-interface computer 16 may instantiate and/or implement independent, redundant, and/or cooperative modules 50.

The acquisition module 52 acquires raw sensor values from each of the sensors 30, i.e., the acquisition module 52 determines digital values corresponding to force, pressure, displacement, and/or touch inputs to the sensors 30. The acquisition module 52 may acquire raw sensor values sequentially, concurrently, and/or periodically as described further herein. The acquisition module 52 may apply sensor offsets, temperature compensation, and/or noise filtering.

The measurement module 54 converts raw sensor values into more useful data for other modules 50 such as the posture module 56, the display module 58, and/or the data log module 60. The measurement module 54 receives raw sensor values from the acquisition module 52. The measurement module 54 may filter and/or process the raw sensor values. For example, the measurement module 54 may average a series of sensor value readings and/or compare the sensor value readings to one or more thresholds (e.g., a threshold for each sensor 30). The measurement module 54 may apply calibration to normalize sensor values between different sensors 30, between different chairs 20, and/or between different acquisition times. The measurement module 54 may convert the raw sensor values into values equivalent to force, pressure, or related physical quantities. The measurement module 54 may convert raw sensor values into an indicator of sensor activity, e.g., a Boolean value of active/inactive, on/off, engaged/disengaged, etc. For example, the measurement module 54 may compare input sensor values to an activity threshold value for each sensor 30 and if the input sensor value corresponds to, e.g., a force greater than the activity threshold, the measurement module 54 may report that sensor 30 as active. The measurement module 54 may compare sensor data from different locations and/or times, and may determine statistics related to one or more sensors 30 (e.g., average value, moving average, standard deviation, time active, count (number) of measurement outcomes, etc.).

The data log module 60 stores data for further analysis. The data log module 60 may receive data from the measurement module 54 (e.g., raw and/or processed sensor values, sensor data statistics) and/or the posture module 56 (e.g., posture data and/or statistics as described further herein).

The display module 58 is a user-interface module that communicates sensor data, posture data, and/or related quantities to the user and may be used by the user to control other modules 50 and/or the system 10. Generally, the display module 58 is a graphical user interface. The display module 58 may be used to visualize, manipulate, and/or summarize sensor data, posture data, and/or related quantities. The display module 58 may display user alerts with information about the user's posture and/or about corrective and/or preventative actions. Additionally or alternatively, the display module 58 may display summaries of chair use and/or posture behavior, e.g., daily graphs of time in each posture type (as discussed further herein) and/or daily distribution graphs of relative time in each posture type. Summaries may be organized by time (e.g., hourly, daily, and/or weekly), by posture type (e.g., individual postures, groups of postures, and/or proper-improper classification of sitting posture), and/or by user. Summaries may be user configurable and/or responsive to user inputs.

The control module 62 controls other modules 50 and may be controlled by the user, e.g., via the display module 58. For example, the control module 62 may turn on and/or turn off data acquisition of the acquisition module 52, may control the measurement parameters of the measurement module 54, may retrieve and/or update calibration data (e.g., activity thresholds) from/to the measurement module 54, and/or may determine which postures are calculated with the posture module 56 (as described further herein).

The posture module 56 receives sensor data from the measurement module 54 and determines which type of posture the sensor data corresponds to. The posture module 56 may calculate the posture type from the input sensor data (e.g., classifying the posture type based upon the input sensor data). The posture types correspond to proper sitting posture and improper sitting posture (e.g., those postures described herein which are not the proper sitting posture). The proper sitting posture includes the user sitting with hips, back, and shoulders against the backrest 26, buttocks and thighs on the seat 22, arms on the armrests 28, and feet on the floor or footrest. The proper sitting posture reduces the likelihood of back, shoulder, neck, and arm strain. Improper sitting postures may lead to back, shoulder, neck, and/or arm strain and/or deleterious health consequences.

The posture module 56 may determine at least seven posture types, based at least in part on at least two of the input sensor values. The posture types may be determined based at least in part on a priority of the posture types (e.g., determining hunching when the sensor input values may indicate either hunching or straining shoulders), a history of posture type determinations, and/or user configuration (e.g., which posture types to determine, sensor thresholds, and/or sensor data filters). The seven types of postures include proper sitting posture and improper sitting posture, which includes, but is not limited to, slouching, hunching, straining shoulders, leaning, sitting on edge, and crossing legs. Each of the proper sitting posture and the improper sitting postures listed are described in more detail with respect to FIGS. 5A-11B.

Figure 5B:
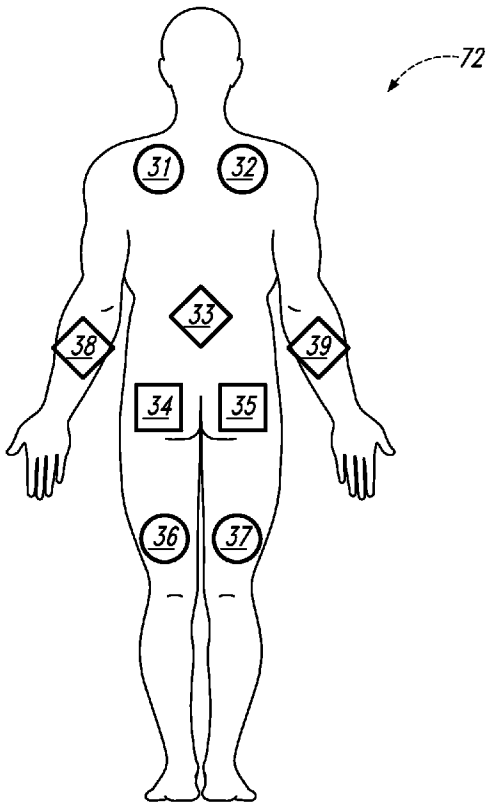
FIG. 5B is a schematic diagram of a sensor configuration corresponding to a slouching posture.
Figure 5A:
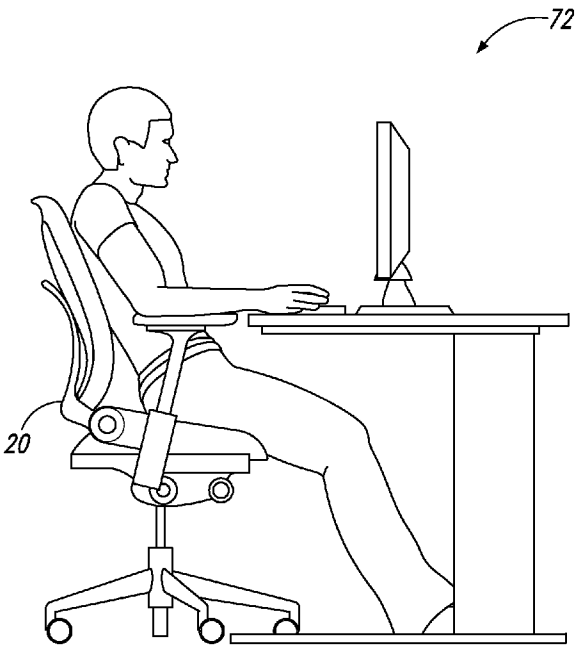
FIG. 5A is an illustration of a slouching posture.

FIG. 5A illustrates a slouching posture 72. In the slouching posture 72, the user does not sit with the hips under the shoulders and the buttocks at the rear of the seat 22. The slouching posture 72 may strain neck and back. The slouching posture 72 is sensed by the chair 20 by lack of body force applied to the buttocks sensors 34, 35. FIG. 5B represents the sensor activity in the slouching posture 72, with sites on the user's body indicated with the corresponding sensors 31-39. Sensors that are receiving sufficient body force are indicated by circle symbols. Sensors that are receiving insufficient body force and/or unbalanced body force are indicated by square symbols. Sensors that do not specifically participate in the determination of the associated posture are indicated by diamond symbols. The same convention and numbering are used throughout FIGS. 5A-11B. The determination of sufficient and insufficient body force may be performed by the measuring module as described herein.

Sufficient body force may be force greater than or equal to a predetermined threshold such as the sensor-specific activity threshold. Insufficient body force may be substantially no force and/or force less than a predetermined threshold (possibly the same threshold used to determine sufficient body force), such as the sensor-specific activity threshold. Unbalanced body force may be a sufficient difference between the force applied at different sites. The corresponding different sensors 30 may have a magnitude of a difference of sensor values that is greater than a predetermined threshold (e.g., a magnitude of a force difference greater than a sensor-pair-specific imbalance threshold).

As shown in FIG. 5B, the slouching posture 72 may be indicated when the shoulder sensors 31, 32 sense a shoulder force (i.e., a sufficient shoulder force), the buttocks sensors 34, 35 sense substantially no buttocks force (i.e., an insufficient buttocks force), and the thigh sensors 36, 37 sense a thigh force (i.e., a sufficient thigh force). Corrective action to cease slouching 72 and/or preventative action to avoid slouching 72 includes sitting with one's hips and upper back against the backrest 26 and using the armrests 28 to keep oneself upright.

Figure 6B:
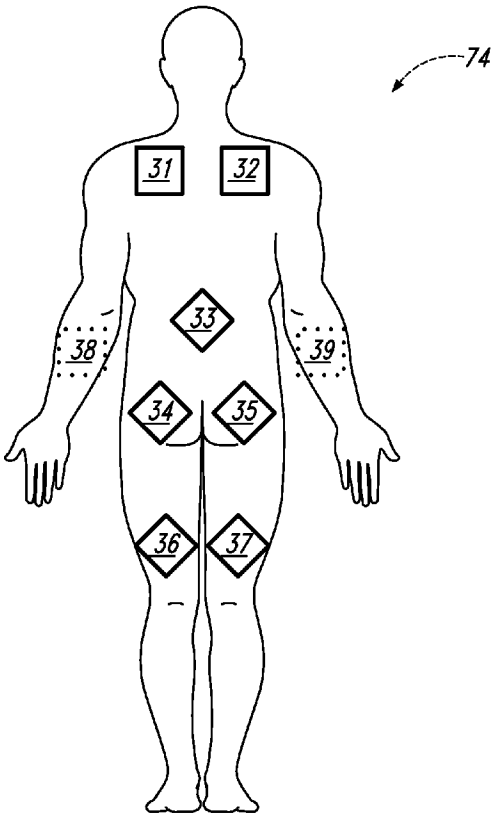
FIG. 6B is a schematic diagram of a sensor configuration corresponding to a hunching posture.
Figure 6A:
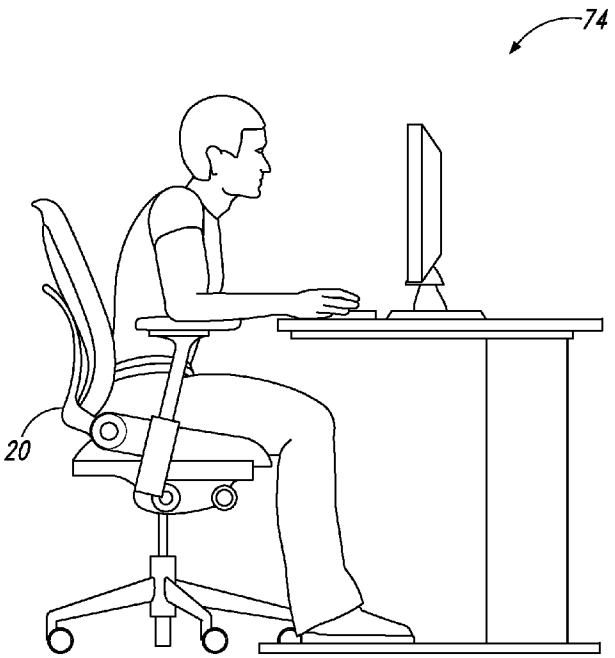
FIG. 6A is an illustration of a hunching posture.

FIG. 6A illustrates a hunching posture 74. In the hunching posture 74, the user does not sit with the upper back and shoulders against the backrest 26. The hunching posture 74 may strain neck and back. As shown in FIG. 6B, the hunching posture 74 is sensed by the chair 20 by lack of body force applied to the shoulder sensors 31, 32 or to the armrest sensors 38, 39. The hunching posture 74 may be indicated when the shoulder sensors 31, 32 sense substantially no shoulder force (i.e., an insufficient shoulder force) and at least one of the other sensors 33-39 sense a body force (i.e., a sufficient force). Alternatively, the hunching posture 74 may be indicated when the arm sensors 38, 39 sense substantially no arm force (i.e., an insufficient arm force) and at least one or the other sensors 31-37 sense a body force. Corrective action to cease hunching and/or preventative action to avoid hunching includes sitting with one's hips, back, and shoulders against the backrest 26, and using the armrests 28 to keep oneself upright.

Figure 7B:
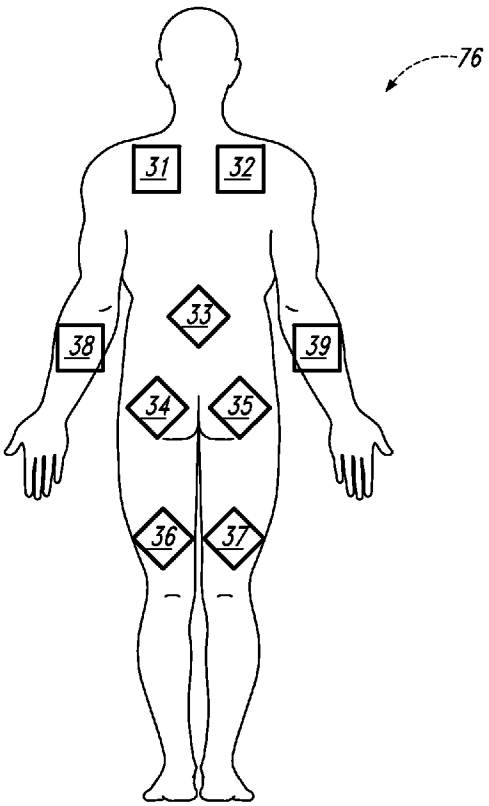
FIG. 7B is a schematic diagram of a sensor configuration corresponding to a shoulder-strain posture.
Figure 7A:
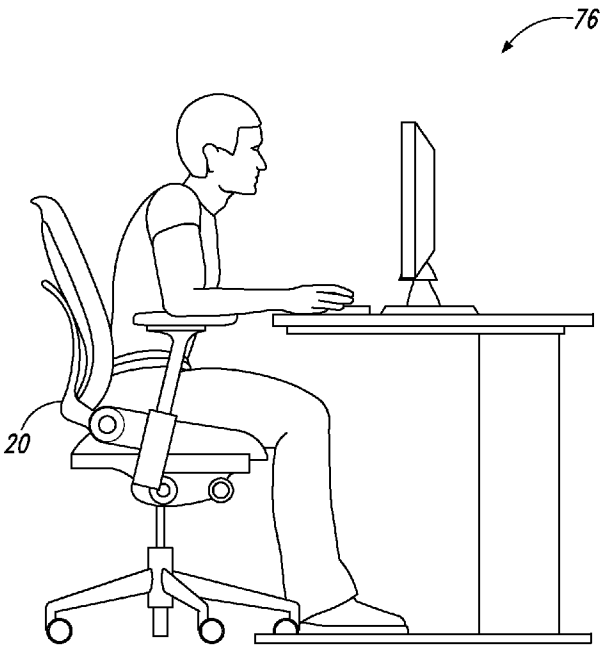
FIG. 7A is an illustration of a shoulder-strain posture.

FIG. 7A illustrates a straining-shoulders posture 76. In the straining-shoulders posture 76, the user does not sit with the upper back and shoulders against the backrest 26 and the user's arms are not resting on the armrests 28. The straining-shoulders posture 76 may strain neck and shoulders, and may lead to hunching. As shown in FIG. 7B, the straining-shoulders posture 76 is sensed by the chair 20 by lack of body force applied to the shoulder sensors 31, 32 and to the armrest sensors 38, 39. The straining-shoulder posture 76 may be indicated when the shoulder sensors 31, 32 sense substantially no shoulder force, the armrest sensors 38, 39 sense substantially no arm force, and at least one of the other sensors 33-37 sense a body force. Corrective action to cease straining shoulders and/or preventative action to avoid straining shoulders includes sitting with one's hips, back, and shoulders against the backrest 26, and using the armrests 28 to keep oneself upright.

Figure 8B:
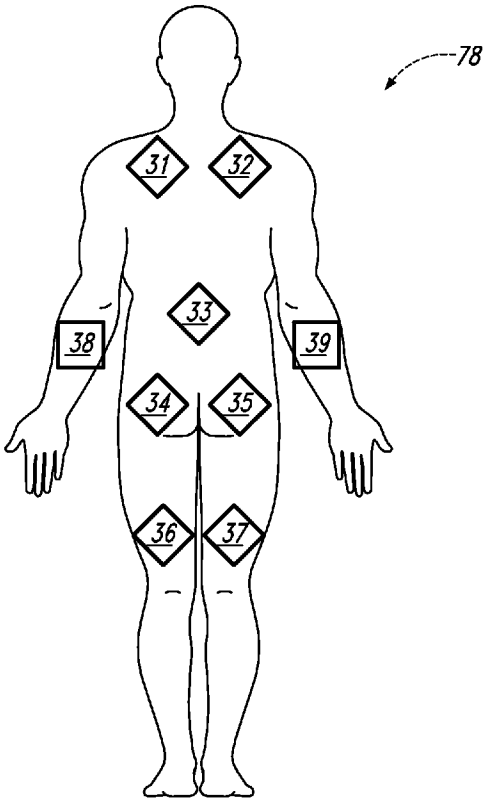
FIG. 8B is a schematic diagram of a sensor configuration corresponding to a leaning-to-side posture.
Figure 8A:
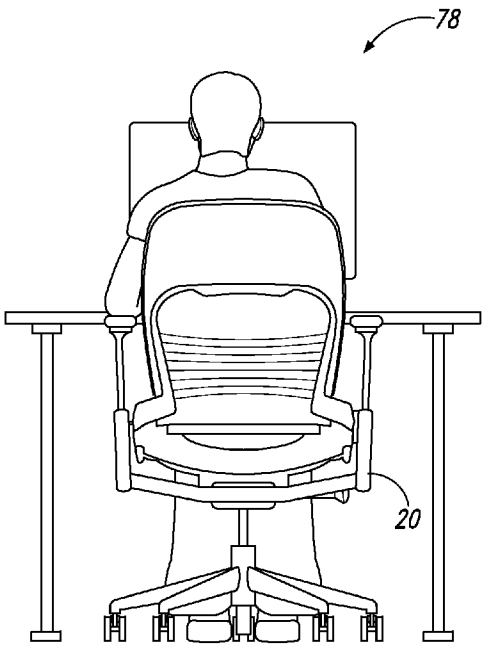
FIG. 8A is an illustration of a leaning-to-side posture.

FIG. 8A illustrates a leaning posture 78. In the leaning posture 78, the user is leaning left or right, using only one of the armrests 28. The leaning posture 78 may strain shoulders and back. As shown in FIG. 8B, the leaning posture 78 is sensed by the chair 20 by an imbalance of arm forces applied to the armrest sensors 38, 39. The leaning posture 78 may be indicated when the right armrest sensor 38 senses a force, or related property, that is sufficiently different than the force, or related property, sensed by the left armrest sensor 39. The sensed forces may be sufficiently different if the magnitude of the difference between the sensor values is greater than a predetermined threshold. Corrective action to cease leaning and/or preventative action to avoid leaning includes identifying the leaning condition and sitting upright with a straight spine.

Figure 9B:
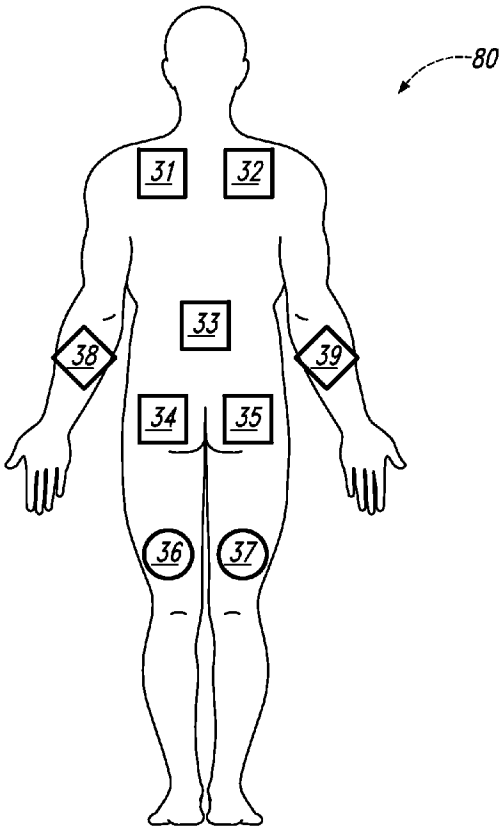
FIG. 9B is a schematic diagram of a sensor configuration corresponding to a sitting-on-edge posture.
Figure 9A:
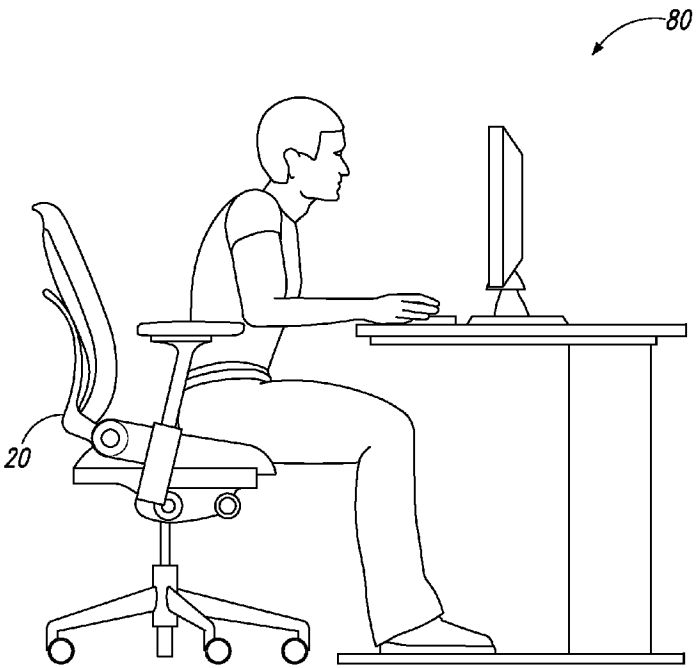
FIG. 9A is an illustration of a sitting-on-edge posture.

FIG. 9A illustrates a sitting-on-edge posture 80. In the sitting-on-edge posture 80, the user is not using the backrest 26 at all. The sitting-on-edge posture 80 lacks trunk support by the chair 20, may strain neck, back, and trunk muscles, and may lead to hunching. As shown in FIG. 9B, the sitting-on-edge posture 80 is sensed by the chair 20 by lack of body force applied to the shoulder sensors 31, 32, the lumbar sensor 33, and the buttocks sensors 34, 35, while body force is applied to the thigh sensors 36, 37. The sitting-on-edge posture 80 may be indicated when the shoulder sensors 31, 32 sense substantially no shoulder force, the lumbar sensor 33 senses substantially no lumbar force (i.e., an insufficient lumbar force), the buttocks sensors 34, 35 sense substantially no buttocks force, and the thigh sensors 36, 37 sense a thigh force. Corrective action to cease sitting on the edge and/or preventative action to avoid sitting on the edge includes sitting with one's hips, back, and shoulders against the backrest 26, and using the armrests 28 to keep oneself upright.

Figure 10B:
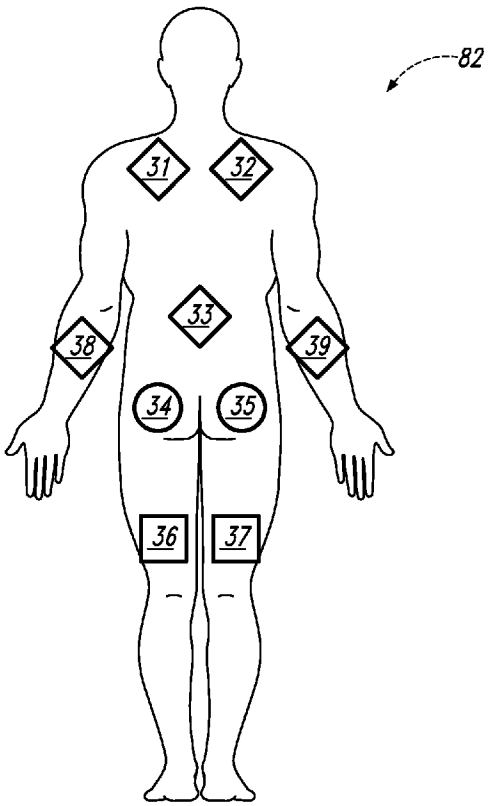
FIG. 10B is a schematic diagram of a sensor configuration corresponding to a leg-crossed posture.
Figure 10A:
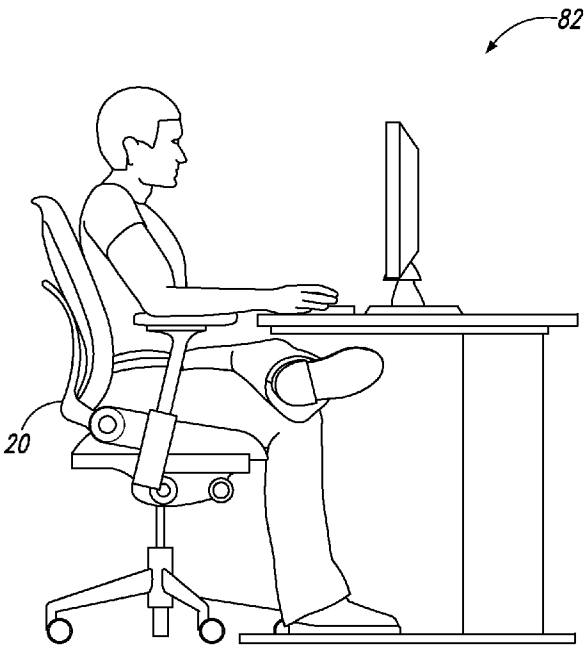
FIG. 10A is an illustration of a leg-crossed posture.

FIG. 10A illustrates a crossing-legs posture 82. In the crossing-legs posture 82, the user sits with legs crossed. The crossing-legs posture 82 may strain the back and reduce blood flow, especially to the legs. As shown in FIG. 10B, the crossing-legs posture 82 is sensed by the chair 20 by an imbalance of thigh forces applied to the thigh sensors 38, 39 and may include sensing a buttocks force applied to the buttocks sensors 34, 35. The crossing-legs posture 82 may be indicated when the right thigh sensor 36 senses a force, or related property, that is sufficiently different than the force, or related property, sensed by the left thigh sensor 37. The sensed forces may be sufficiently different if the magnitude of the difference between the sensor values is greater than a predetermined threshold. Additionally, the crossing-legs posture 82 may be indicated when the buttocks sensors 34, 35 sense a buttocks force (i.e., a sufficient buttocks force). Corrective action to cease crossing legs includes standing up and then sitting with both feet on the floor or footrest. Preventative action to avoid crossing legs includes sitting with both feet on the floor or footrest.

Figure 11B:
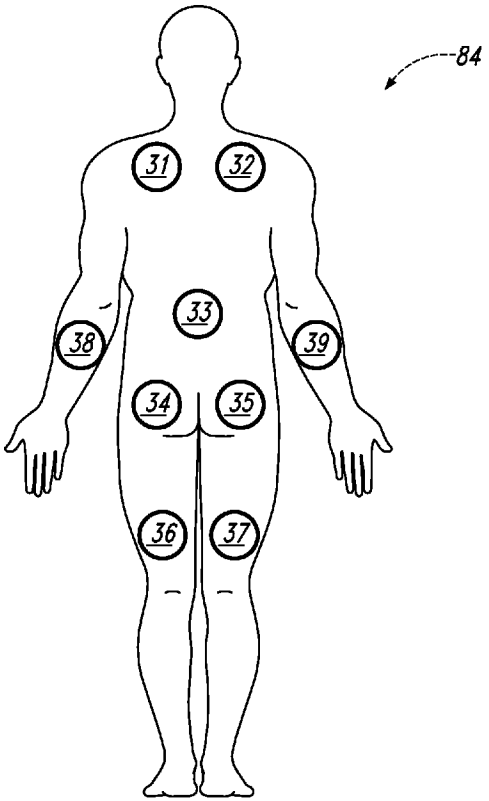
FIG. 11B is a schematic diagram of a sensor configuration corresponding to a proper posture.
Figure 11A:
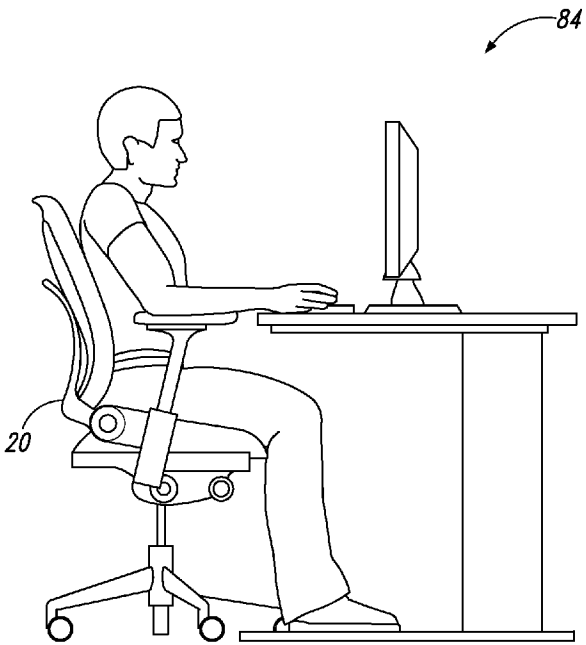
FIG. 11A is an illustration of a proper posture.

FIG. 11A illustrates a proper sitting posture 84. In the proper sitting posture 84, the user sits with hips, back, and shoulders against the backrest 26, arms on the armrests 28, and feet on the floor or footrest. The proper sitting posture 84 reduces the likelihood of back, shoulder, neck, and arm strain. As shown in FIG. 11B, the proper sitting posture 84 is sensed by the chair 20 by body force applied to all sensors 31-39. The proper sitting posture 84 may be indicated when the shoulder sensors 31, 32 sense a shoulder force, the lumbar sensor 33 senses a lumbar force (i.e., a sufficient lumbar force), the buttocks sensors 34, 35 sense a buttocks force, the thigh sensors 36, 37 sense a thigh force, and the arm sensors 38, 39 sense an arm force (i.e., a sufficient arm force).

Maintaining a proper sitting posture for too long of a time may yet lead to strain, musculoskeletal discomfort, and/or poor circulation. To reduce the risk of these maladies, one should periodically stand up and move for at least a short period of time. For example, taking a break from sitting every 20-30 minutes by standing up and moving for 10-20 seconds is a healthful habit. The posture module 56 and/or the control module 62 (FIG. 4) may monitor the length of time a user is in the proper sitting posture 84. When the user has sat in the proper sitting posture 84 for a predefined threshold time, also called a break interval time, the control system 12 may signal the user with the display module 58 to take a break. The break interval time may be about 10 minutes, about 20 minutes, about 30 minutes, or about 40 minutes. The control system 12 also may indicate the duration and/or the end of the break. The control system 12 may indicate a break duration of at most 2 minutes, at most 1 minute, or at most 30 seconds.

If the posture module 56 indicates a posture type that is improper sitting posture, the control system 12 may signal the user with the display module 58 of the improper sitting posture, for example, displaying an alert that describes the improper sitting posture, corrective actions, and/or preventative actions. The control system 12 may be configured and/or programmed to signal the user of improper sitting postures if the user remains in an improper sitting posture for longer than a predefined time (an optionally user-configurable time limit), also called an improper sitting posture time. The improper sitting posture time may the same or different for any of the posture types. Examples of improper sitting posture times are 5 seconds, 10 seconds, 20 seconds, and 1 minute. The user may configure the control system 12 to suppress and/or ignore one or more types of posture alerts, e.g., suppressing hunching posture alerts. When alerts based on a posture type are suppressed and/or ignored, the alerts may be stored in a log and/or the alerts may be suppressed and/or ignored for a predefined period of time (e.g., about 10 minutes, about 30 minutes, about 1 hour) and/or until a predefined event (e.g., user stops using chair, one or more sensors are activated).

The posture module 56 and/or the control module 62 (FIG. 4) may monitor the length of time the chair 20 is in use and/or not in use (i.e., the time the user is sitting and/or not sitting in the chair 20). The time of use and/or non-use may be recorded with the data log module 60 and/or displayed with the display module 58 (e.g., as a part of use statistics).

Figure 12:
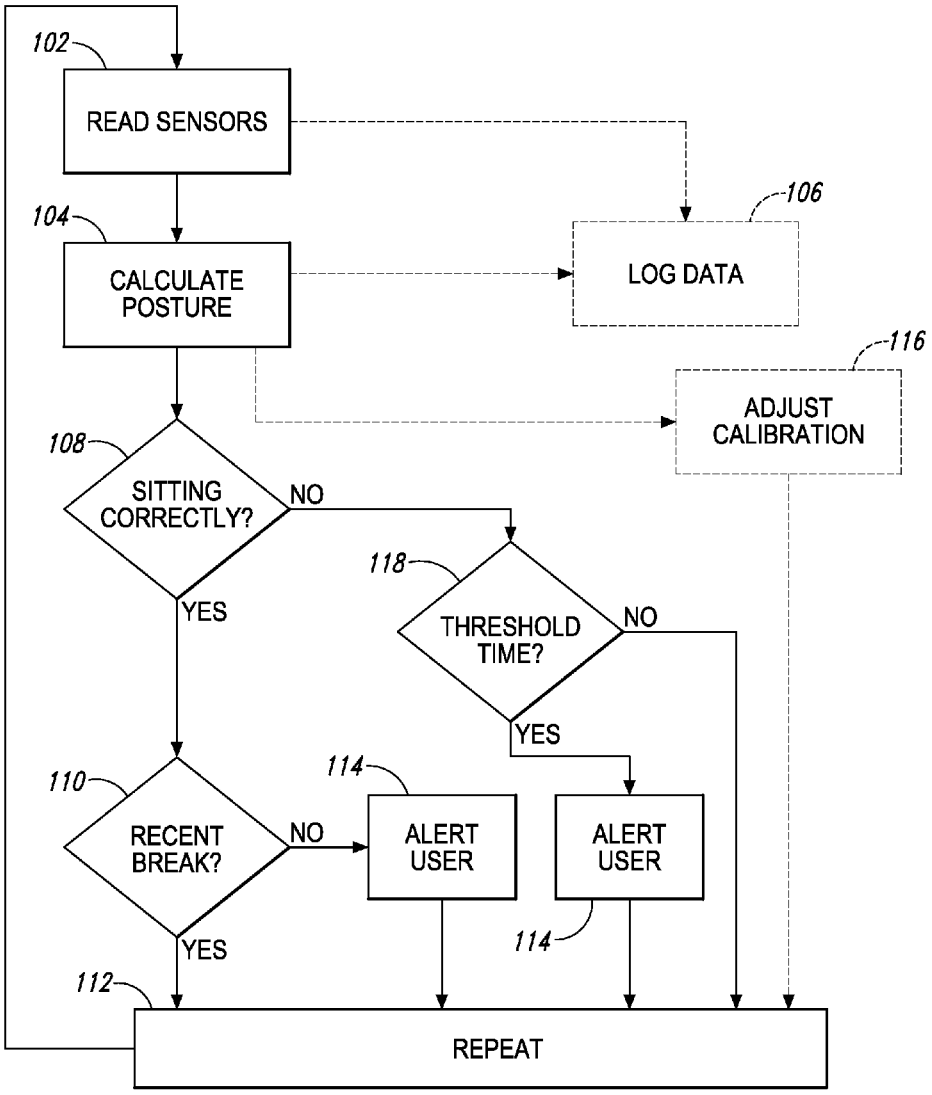
FIG. 12 is a schematic representation of methods of notifying a user of posture.

FIG. 12 schematically represents methods 100 of using the system 10 and/or the chair 20. Methods 100 may be methods of promoting ergonomic posture of the user sitting in the chair. Additionally or alternatively, methods 100 may include methods of controlling a device and/or a vehicle (e.g., an aircraft) via posture-based user inputs. Methods 100 include reading 102 sensors, calculating 104 posture, optionally logging 106 data, determining 108 if the user is sitting properly, determining 110 if the user took a recent break and/or determining 118 if the user has been sitting improperly too long, and repeating 112.

Reading 102 may include reading sensor values from two or more sensors 30 and optionally all sensors 30. For example, reading 102 may include reading a first sensor value from a first sensor in a body support (i.e., the seat, the backrest, or one of the armrests), and reading a second sensor value from a second sensor in the same or different body support. The first and second sensors may be in different locations (e.g., respective first and second locations) under or in the same chair pad and/or in the same body support, or may be located in different body supports (e.g., respective first and second body supports). As another example, reading 102 may include reading a right shoulder sensor value from the right shoulder sensor 31, a left shoulder sensor value from the left shoulder sensor 32, a lumbar sensor value from the lumbar sensor 33, a right buttocks sensor value from the right buttocks sensor 34, a left buttocks sensor value from the left buttocks sensor 35, a right thigh sensor value from the right thigh sensor 36, a left thigh sensor value from the left thigh sensor 37, a right armrest sensor value from the right armrest sensor 38, and a left armrest sensor value from the left armrest sensor 39. Reading 102 of the selected sensors may be performed concurrently as discussed herein, for example, with all selected sensors read within a defined time period that is less than 5 seconds, less than 2 seconds, or less than 1 second. Reading 102 may include operating the acquisition module 52 and/or the measuring module 54, as described with respect to FIG. 4.

Calculating 104 may include calculating a posture type based at least in part on sensor values from two or more (optionally all) sensors. For example, calculating 104 may include calculating a posture type based at least in part on the first sensor value and the second sensor value. The posture types calculated may be one of improper posture and proper posture. As discussed herein, improper posture may be one of the following posture types: slouching, hunching, straining shoulders, leaning, sitting on edge, and crossing legs. Calculating 104 may include calculating a posture type based at least in part on a priority of the posture types (e.g., determining hunching when the sensor input values may indicate either hunching or straining shoulders), a history of posture type determinations, and/or user configuration (e.g., which posture types to determine, sensor thresholds, and/or sensor data filters). For example, calculating 104 may include comparing sensor values to the corresponding activity thresholds as discussed further herein. Calculating 104 may include determining that the posture type is proper when at least two sensor values indicate sufficient body force is applied (i.e., when at least two sensor values indicate activity). Calculating 104 may include determining that a sensor value indicates insufficient body force is applied (i.e., the sensor value indicates inactivity).

Figure 13:
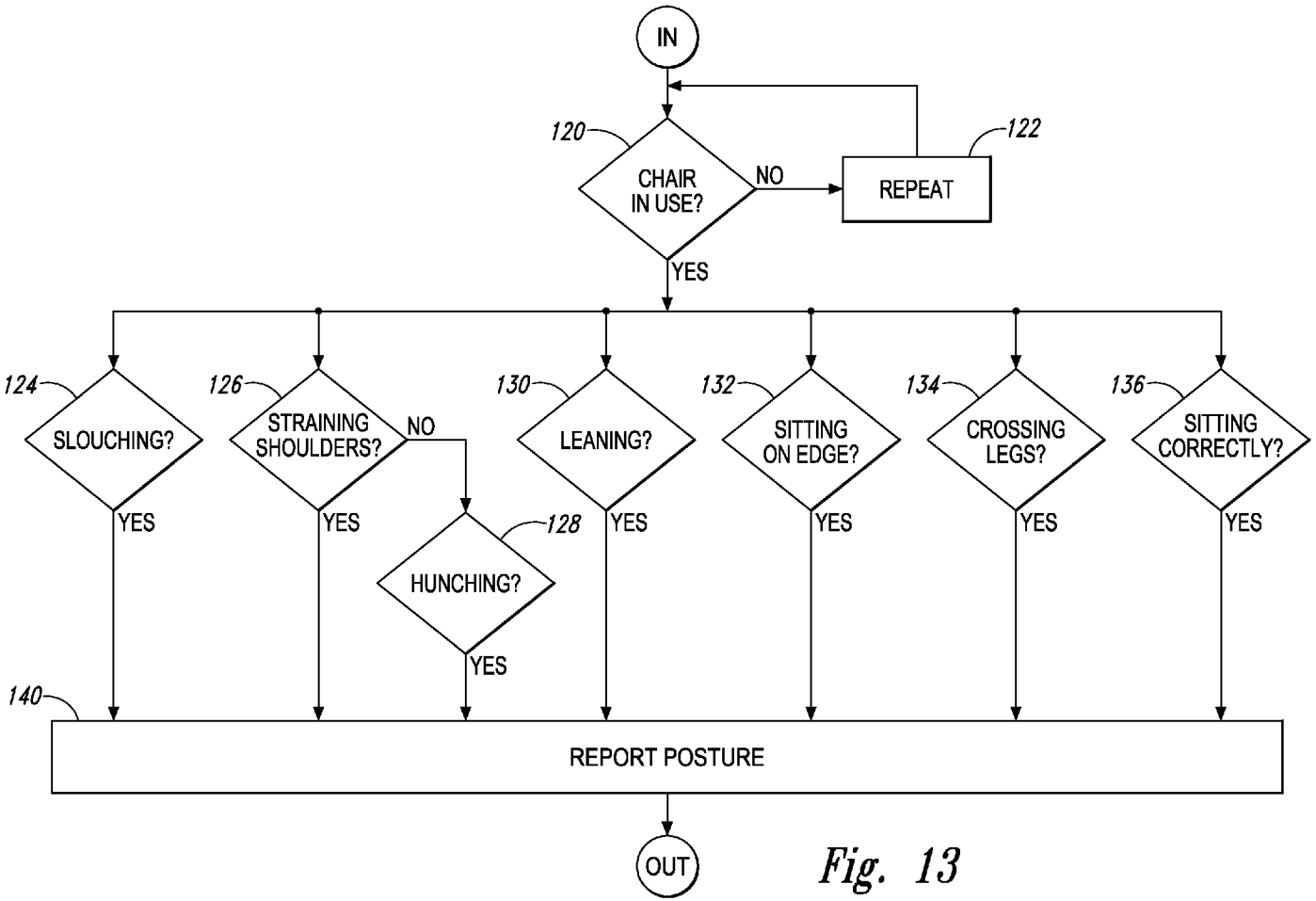
FIG. 13 is a schematic representation of methods of calculating posture.

As indicated in FIG. 13, calculating 104 may include determining 120 that the chair is in use, e.g., by determining that at least one sensor is active (i.e., indicates a body force, or related physical interaction, that is greater than a sensor-specific activity threshold). If the chair is not in use, calculating 104 may include repeating 122 the determining 120 (as indicated by the 'No' branch of determining 120 in FIG. 13). If the chair is in use, calculating 104 may include calculating the posture type (as indicated by the 'Yes' branch of determining 120 in FIG. 13). Further, calculating 104 may include reporting 140 the posture type.

Calculating 104 may include determining 124 that the posture type is slouching when the right shoulder sensor value indicates activity, the left shoulder sensor value indicates activity, the right buttocks sensor value indicates inactivity, the left buttocks sensor value indicates inactivity, the right thigh sensor value indicates activity, and the left thigh sensor value indicates activity.

Calculating 104 may include determining 126 that the posture type is straining shoulders when the right shoulder sensor value indicates inactivity, the left shoulder sensor value indicates inactivity, the right armrest sensor value indicates inactivity, the left armrest sensor value indicates inactivity, and at least one of the other sensor values (e.g., the lumbar sensor value, the right buttocks sensor value, the left buttocks sensor value, the right thigh sensor value, and the left thigh sensor value) indicates activity.

Calculating 104 may include determining 128 that the posture type is hunching when the right shoulder sensor value indicates inactivity, the left shoulder sensor value indicates inactivity, and at least one of the other sensor values (e.g., the lumbar sensor value, the right buttocks sensor value, the left buttocks sensor value, the right thigh sensor value, the left thigh sensor value, the right armrest sensor value, and the left armrest sensor value) indicates activity. Further, determining 128 may include indicating that the posture type is hunching only if the posture type also is not straining shoulders.

Calculating 104 may include determining 130 that the posture type is leaning when the right armrest sensor value indicates a significantly different arm force than the left armrest sensor value. A significantly different arm force may be the magnitude of the difference of right armrest sensor value and the left armrest sensor value being greater than a predetermined threshold (e.g., an arm force imbalance threshold). The direction of the lean may be determined by the sign of the difference of the right armrest sensor value and the left armrest sensor value.

Calculating 104 may include determining 132 that the posture type is sitting on edge when the right shoulder sensor value indicates inactivity, the left shoulder sensor value indicates inactivity, the lumbar sensor value indicates inactivity, the right buttocks sensor value indicates inactivity, the left buttocks sensor value indicates inactivity, the right thigh sensor value indicates activity, and the left thigh sensor value indicates activity.

Calculating 104 may include determining 134 that the posture type is crossing legs when the right thigh sensor value indicates a significantly different thigh force than the left thigh sensor value and optionally when the right buttocks sensor value indicates activity and the left buttocks sensor value indicates activity. A significantly different thigh force may be the magnitude of the difference of right thigh sensor value and the left thigh sensor value being greater than a predetermined threshold (e.g., a thigh force imbalance threshold). The direction of the crossed thighs may be determined by the sign of the difference of the right thigh sensor value and the left thigh sensor value.

Calculating 104 may include determining 136 that the posture type is proper sitting posture when the right shoulder sensor value indicates activity, the left shoulder sensor value indicates activity, the lumbar sensor value indicates activity, the right buttocks sensor value indicates activity, the left buttocks sensor value indicates activity, the right thigh sensor value indicates activity, the left thigh sensor value indicates activity, the right armrest sensor value indicates activity, and the left armrest sensor value indicates activity.

Calculating 104 may include operating the posture module 56 and/or the measurement module 54, as described with respect to FIG. 4.

Returning to FIG. 12, logging 106 data may include storing sensor value data and/or posture type data as obtained by the reading 102 and/or the calculating 104. Logging 106 data may include storing data in memory 206 and/or storage media 212, as described further herein with respect to FIG. 14. Logging 106 data may include transmitting data via communications infrastructure 210 to memory 206, storage media 212, and/or a computer system, as described further herein with respect to FIG. 14. Logging 106 data may include operating the data log module 60, the measurement module 54, the posture module 56, and/or the display module 58, as described with respect to FIG. 4.

Determining 108 if the user is sitting properly may include comparing the posture type calculated by calculating 104 to the proper sitting posture. If the posture type is determined to be the proper sitting posture, the method 100 may proceed to the determining 110 (as indicated by the 'Yes' branch of determining 108 in FIG. 12). If the posture type is determined to be one of the improper sitting postures (e.g., one of the other posture types), the method 100 may proceed to determining 118 (as indicated by the 'No' branch of determining 108 in FIG. 12) and optionally to alerting 114 the user (as described further herein) of the improper sitting posture and/or corrective actions. Determining 108 may include operating the posture module 56 and/or the display module 58, as described with respect to FIG. 4.

Determining 110 if the user took a recent break may include determining the time the user has been continuously sitting properly and/or determining if a break was sufficiently recent. Determining 110 may include recording a reference time that the user changed to a proper sitting posture. Each time the user changes to a different posture, the reference time may be updated. The time the user has been continuously sitting properly and/or the time since the most recent break may be determined by comparing the current time (of the current posture type calculated by calculating 104) with the reference time. Additionally or alternatively, a reference counter may be reset every time the user is calculated to be in an improper sitting posture (i.e., a posture type other than the proper sitting posture) and the reference counter may be incremented every time the user is calculated to be in a proper sitting posture. The time the user has been continuously sitting properly and/or the time since the most recent break may be determined by comparing the current value of the reference counter to a predetermined threshold corresponding to a break interval. Further additionally or alternatively, the time of initiation of use of the chair (e.g., the time the last break terminated) may be recorded. The time the user has been continuously sitting and/or the time since the most recent break (micro-break or otherwise) may be determined by comparing the current time (of the current posture type calculated by calculating 104) with the most recent initiation time.

If the determining 110 indicates that a break from sitting was recent (e.g., more recent than a predetermined break interval), the method may complete or repeat 112 (as indicated by the 'Yes' branch of determining 110 in FIG. 12). If the determining 110 indicates that a break was not recent (e.g., less recent than a predetermined break interval), the method may proceed to alerting 114 the user that a break is due (as indicated by the 'No' branch of determining 110 in FIG. 12). The break interval may be about 10 minutes, about 20 minutes, about 30 minutes, or about 40 minutes. Determining 110 may include operating the posture module 56, the display module 58, and/or the control module 62, as described with respect to FIG. 4.

Alerting 114 may include displaying a message to the user on a user-interface computer. The message may be visual, audio, and/or tactile. If the alerting 114 includes indicating a posture type, alerting 114 may include displaying corrective and/or preventative action instructions. If the alerting 114 includes indicating a break is due, alerting 114 may include indicating the duration of the break and/or the end of the break. The duration of a break may be 5 minutes, 10 minutes, 15 minutes, 20 minutes, 30 minutes, 45 minutes, 60 minutes, or however long desired. The duration of a break may also be less than 2 minutes, less than 1 minute, or less than 30 seconds. Short breaks (e.g., breaks of less than 2 minutes, less than 1 minute, or less than 30 seconds), which may be referred to as micro-breaks, may be useful to improve circulation and to avoid the deleterious effects of maintaining a static position without significantly interrupting job performance. Alerting 114 may include operating the display module 58 and/or the control module 62, as described with respect to FIG. 4.

Determining 118 if the user has been in an improper sitting posture too long may include determining the time the user has been continuously sitting in the same improper sitting posture and/or determining if the user's posture changed sufficiently long ago. Determining 118 may include recording a reference time that the user changed to an improper sitting posture. Each time the user changes to a different posture, the reference time may be updated. The time the user has been continuously in an improper sitting posture and/or the time since the most recent posture change may be determined by comparing the current time (of the current posture type calculated by calculating 104) with the reference time. Additionally or alternatively, a reference counter may be reset every time the user changes posture and the reference counter may be incremented every time the user is calculated to be sitting in the same posture. The time the user has been continuously sitting improperly and/or the time since the most recent posture change may be determined by comparing the current value of the reference counter to a predetermined threshold corresponding to the time sitting improperly. Methods 100 may include determining 110 if the user took a recent break (e.g., sitting properly too long) and determining 118 if the user has been sitting improperly too long.

If the determining 118 indicates that a posture change was recent (e.g., more recent than the improper sitting posture time), the method may complete or repeat 112 (as indicated by the 'No' branch of determining 118 in FIG. 12). If the determining 118 indicates that a posture change was sufficiently long ago (e.g., less recent than the improper sitting posture time), the method may proceed to alerting 114 the user of the improper sitting posture (as indicated by the 'Yes' branch of determining 118 in FIG. 12). The improper sitting posture time may be the same or different for different improper sitting posture types and may be, e.g., 5 seconds, 10 seconds, 20 seconds, or 1 minute. The improper sitting posture time generally is shorter than the break interval used to indicate whether the user has been sitting properly too long. Determining 118 may include operating the posture module 56, the display module 58, and/or the control module 62, as described with respect to FIG. 4.

Repeating 112 may include repeating the reading 102, the calculating 104, the determining 108, and the determining 110. Repeating 112 may include repeating until a threshold time and/or event. For example, repeating 112 may include repeating until a break is warranted, until the user has been continuously sitting properly for a predetermined threshold time (e.g., a break interval), until the user ceases use of the chair, and/or until a threshold time has been exceed. Repeating 112 may include reading 102 substantially periodically (thus, acquiring sensor data substantially periodically). Repeating 112 may include conditionally alerting 114 the user of posture, status messages, and/or breaks. Repeating 112 may include operating the control module 62 and/or the display module 58, as described with respect to FIG. 4.

Methods 100 may include adjusting 116 calibration. Adjusting 116 calibration may include accepting user inputs to change the sensor configuration (use, sensitivity, offset, and/or activity threshold), the alert configuration (turn on or off one or more, e.g., all, alerts for improper sitting posture types), and/or the break configuration (specifying the break interval and/or the break duration).

Figure 14:
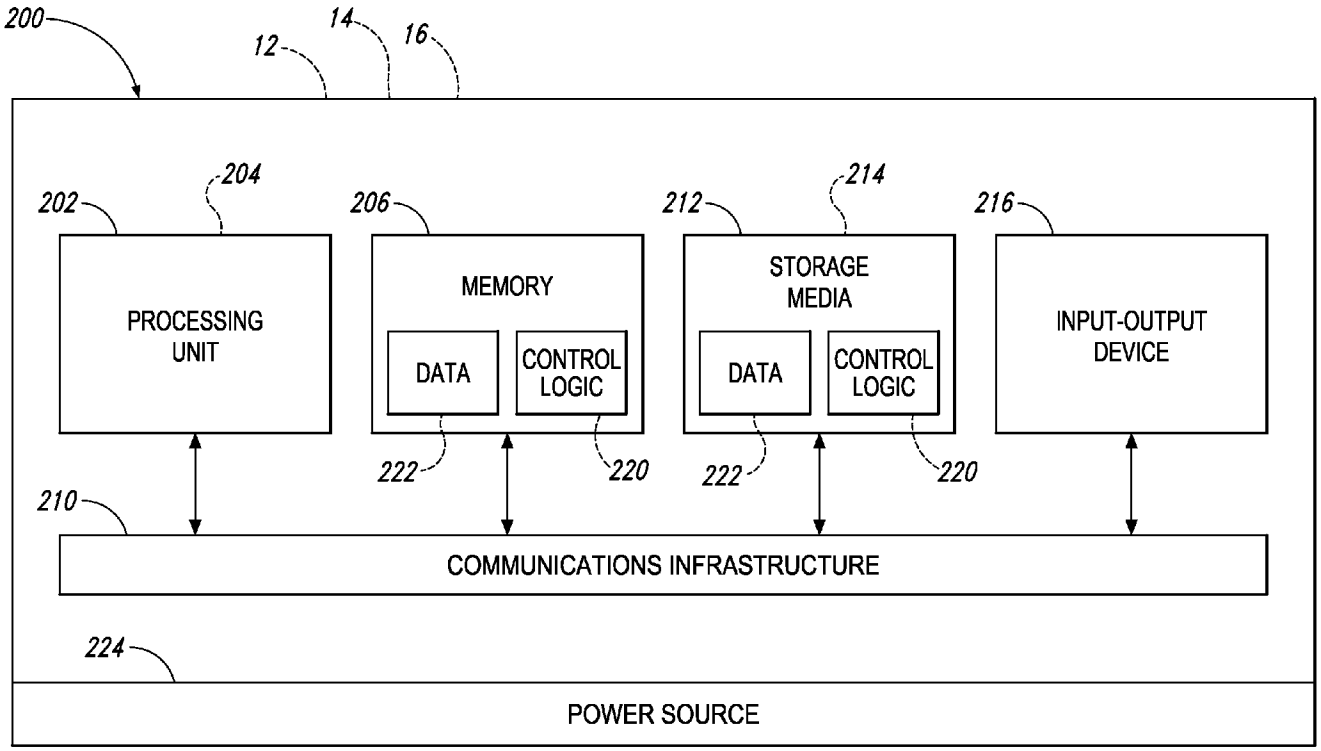
FIG. 14 is a schematic representation of a computerized system.

FIG. 14 schematically represents a computerized system 200 (e.g., control system 12, controller 14 and/or user-interface computer 16) that may be used to implement and/or instantiate modules 50. The computerized system 200 includes a processing unit 202 operatively coupled to a computer-readable memory 206 by a communications infrastructure 210. The processing unit 202 may include one or more computer processors 204 and may include a distributed group of computer processors 204. The computerized system 200 also may include a computer-readable storage media assemblage 212 that is operatively coupled to the processing unit 202 and/or the computer-readable memory 206, e.g., by communications infrastructure 210. The computer-readable storage media assemblage 212 may include one or more non-transitory computer-readable storage media 214 and may include a distributed group of non-transitory computer-readable storage media 214. The computer-readable storage media assemblage 212 typically includes a medium that is configured to store computer instructions (e.g., a hard drive, flash memory, and/or RAM) and does not include transitory, propagating electrical or electromagnetic signals per se.

The communications infrastructure 210 may include a local data bus, a communication interface, and/or a network interface. The communications infrastructure 210 may be configured to transmit and/or to receive signals, such as electrical, electromagnetic, optical, and/or acoustic signals. The communications infrastructure 210 may be configured to communicate with wired and/or wireless protocols (via communications link 18). For example, the communications infrastructure 210 may be configured to communicate with Ethernet protocol (e.g., compliant with IEEE 802.3 standards), BLUETOOTH protocol, and/or WI-FI protocol (e.g., compliant with IEEE 802.11 standards).

The computerized system 200 may include one or more input-output devices 216 operatively coupled to the processing unit 202, the computer-readable memory 206, and/or the computer-readable storage media assemblage 212. Examples of input-output devices 216 include monitors, keyboards, pointing devices (e.g., mice), touch screens, speakers, etc.

The computerized system 200 may include a distributed group of computers, servers, workstations, etc., which each may be interconnected directly or indirectly (including by network connection). Thus, the computerized system 200 may include one or more processing units 202, computer-readable memories 206, computer-readable storage media assemblages 212, and/or input-output devices 216 that are located remotely from one another.

One or both of the computer-readable memory 206 and the computer-readable storage media assemblage 212 include control logic 220 and/or data 222. Control logic 220 (which may also be referred to as software, firmware, and/or hardware) may include instructions that, when executed by the processing unit 202, cause the computerized system 200 to perform one or more of the methods described herein. Control logic 220 may include one or more of the modules 50. Data 222 may include the sensor data, posture data, and/or data associated with the methods 100 and/or one or more of the modules 50.

Examples of inventive subject matter according to the present disclosure are described in the following enumerated paragraphs.

A1. An ergonomics awareness chair comprising:

a chair including a seat, a seat support, a backrest, and at least one armrest;

a group of at least two shoulder sensors in the backrest, wherein each shoulder sensor is configured to sense force from a user's shoulder against the backrest;

a lumbar sensor in the backrest, wherein the lumbar sensor is configured to sense force from a user's lumbar region against the backrest;

a group of at least two buttocks sensors in the seat, wherein each buttocks sensor is configured to sense force from a user's buttocks on the seat;

a group of at least two thigh sensors in the seat, wherein each thigh sensor is configured to sense force from a user's thigh on the seat;

an armrest sensor in each armrest, wherein each armrest sensor is configured to sense force from a user's arm on the respective armrest; and a controller configured to acquire sensor values from the shoulder sensors, the lumbar sensor, the buttocks sensors, the thigh sensors, and the armrest sensor of each armrest.

A2. The ergonomics awareness chair of paragraph A1, wherein the ergonomics awareness chair includes two shoulder sensors, wherein one shoulder sensor is configured to sense force from a user's right shoulder and the other shoulder sensor is configured to sense force from a user's left shoulder.

A3. The ergonomics awareness chair of any of paragraphs A1-A2, wherein the ergonomics awareness chair includes a single lumbar sensor.

A4. The ergonomics awareness chair of any of paragraphs A1-A3, wherein the ergonomics awareness chair includes two buttocks sensors, wherein one buttocks sensor is configured to sense force from a user's right side buttocks and the other buttocks sensor is configured to sense force from a user's left side buttocks.

A5. The ergonomics awareness chair of any of paragraphs A1-A4, wherein the ergonomics awareness chair includes two thigh sensors, wherein one thigh sensor is configured to sense force from a user's right thigh and the other thigh sensor is configured to sense force from a user's left thigh.

A6. The ergonomics awareness chair of any of paragraphs A1-A5, wherein the ergonomics awareness chair includes a right armrest with a single right armrest sensor and a left armrest with a single left armrest sensor, wherein the right armrest is configured to support a user's right arm, the right armrest sensor is configured to sense force from the user's right arm, the left armrest is configured to support a user's left arm, and the left armrest sensor is configured to sense force from the user's left arm.

A7. The ergonomics awareness chair of any of paragraphs A1-A6, wherein at least one sensor of the shoulder sensors, the lumbar sensor, the buttocks sensors, the thigh sensors, and the armrest sensors is a force sensitive resistor.

A7.1. The ergonomics awareness chair of paragraph A7, wherein at least one, optionally each, shoulder sensor is a force sensitive resistor.

A7.2. The ergonomics awareness chair of any of paragraphs A7-A7.1, wherein the lumbar sensor is a force sensitive resistor.

A7.3. The ergonomics awareness chair of any of paragraphs A7-A7.2, wherein at least one, optionally each, armrest sensor is a force sensitive resistor.

A8. The ergonomics awareness chair of any of paragraphs A1-A7.3, wherein at least one sensor of the shoulder sensors, the lumbar sensor, the buttocks sensors, the thigh sensors, and the armrest sensors is a piezoelectric sensor.

A8.1. The ergonomics awareness chair of paragraph A8, wherein at least one, optionally each, buttocks sensor is a piezoelectric sensor.

A8.2. The ergonomics awareness chair of any of paragraphs A8-A8.1, wherein at least one, optionally each, thigh sensor is a piezoelectric sensor.

A8.3. The ergonomics awareness chair of any of paragraphs A8-A8.2, wherein at least one, optionally each, armrest sensor is a piezoelectric sensor.

A9. The ergonomics awareness chair of any of paragraphs A1-A8.3, wherein at least one, optionally each, sensor of the shoulder sensors, the lumbar sensor, the buttocks sensors, the thigh sensors, and the armrest sensors is located beneath a chair pad.

A10. The ergonomics awareness chair of any of paragraphs A1-A9, wherein at least one sensor of the shoulder sensors, the lumbar sensor, the buttocks sensors, the thigh sensors, and the armrest sensors is coupled to a corresponding force enhancer.

A10.1. The ergonomics awareness chair of paragraph A10, wherein at least one, optionally each, shoulder sensor is coupled to a corresponding shoulder force enhancer.

A10.2. The ergonomics awareness chair of any of paragraphs A10-A10.1, wherein the lumbar sensor is coupled to a lumbar force enhancer.

A10.3. The ergonomics awareness chair of any of paragraphs A10-A10.2, wherein at least one, optionally each, buttocks sensor is coupled to a corresponding buttocks force enhancer.

A10.4. The ergonomics awareness chair of any of paragraphs A10-A10.3, wherein at least one, optionally each, thigh sensor is coupled to a corresponding thigh force enhancer.

A10.5. The ergonomics awareness chair of any of paragraphs A10-A10.4, wherein the corresponding force enhancer is a structure with a base coupled to a sensing surface of the respective sensor, and optionally wherein the structure of the force enhancer is at least one of dome-shaped, pyramidal, and conical.

A10.6. The ergonomics awareness chair of any of paragraphs A10-A10.5, wherein the force enhancer contacts a sensing surface of the respective sensor and a chair pad of the chair.

A10.7. The ergonomics awareness chair of any of paragraphs A10-A10.6, wherein at least one, optionally each, sensor is coupled to a single corresponding force enhancer.

A11. The ergonomics awareness chair of any of paragraphs A1-A10.7, wherein the chair includes a battery configured to power the controller, the shoulder sensors, the lumbar sensor, the buttocks sensors, the thigh sensors, and the armrest sensor of each armrest.

A12. The ergonomics awareness chair of any of paragraphs A1-A11, wherein the ergonomics awareness chair is configured to detect at least seven types of postures, based at least in part on at least two of the sensor values, and wherein the at least seven types of postures include slouching, hunching, straining shoulders, leaning, sitting on edge, crossing legs, and proper sitting posture.

A13. The ergonomics awareness chair of any of paragraphs A1-A12, wherein the controller is configured to determine at least seven types of postures, based at least in part on at least two of the sensor values, and wherein the at least seven types of postures include slouching, hunching, straining shoulders, leaning, sitting on edge, crossing legs, and proper sitting posture.

A14. The ergonomics awareness chair of any of paragraphs A1-A13, wherein the controller is configured to indicate a slouching posture when the shoulder sensors sense a shoulder force, the buttocks sensors sense substantially no buttocks force, and the thigh sensors sense a thigh force.

A15. The ergonomics awareness chair of any of paragraphs A1-A14, wherein the controller is configured to indicate a hunching posture when the shoulder sensors sense substantially no shoulder force and at least one of the other sensors sense a body force, wherein the other sensors are the lumbar sensor, the buttocks sensors, the thigh sensors, and the armrest sensor of each armrest.

A16. The ergonomics awareness chair of any of paragraphs A1-A15, wherein the controller is configured to indicate a straining-shoulders posture when the shoulder sensors sense substantially no shoulder force, the armrest sensor in each armrest senses substantially no arm force, and at least one of the other sensors sense a body force, wherein the other sensors are the lumbar sensor, the buttocks sensors, and the thigh sensors.

A17. The ergonomics awareness chair of any of paragraphs A1-A16, wherein the controller is configured to indicate a leaning posture when the armrest sensor in each armrest senses a different arm force.

A18. The ergonomics awareness chair of any of paragraphs A1-A17, wherein the controller is configured to indicate a sitting-on-edge posture when the shoulder sensors sense substantially no shoulder force, the lumbar sensor senses substantially no lumbar force, the buttocks sensors sense substantially no buttocks force, and the thigh sensors sense a thigh force.

A19. The ergonomics awareness chair of any of paragraphs A1-A18, wherein the controller is configured to indicate a crossing-legs posture when the buttocks sensors sense a buttocks force and the thigh sensors sense different thigh forces.

A20. The ergonomics awareness chair of any of paragraphs A1-A19, wherein the controller is configured to indicate a proper sitting posture when the shoulder sensors sense a shoulder force, the lumbar sensor senses a lumbar force, the buttocks sensors sense a buttocks force, the thigh sensors sense a thigh force, and the armrest sensor in each armrest senses an arm force.

A21. The ergonomics awareness chair of any of paragraphs A1-A20, wherein the controller is configured to signal a break after a threshold time in a proper sitting posture.

A22. The ergonomics awareness chair of any of paragraphs A1-A21, wherein the controller is configured to communicate wirelessly with a user-interface computer.

A22.1. The ergonomics awareness chair of paragraph A22, wherein the controller is configured to communicate the sensor values to the user-interface computer.

A22.2. The ergonomics awareness chair of any of paragraphs A22-A22.1, when also dependent on paragraph A13, wherein the controller is configured to communicate a posture determined from the sensor values to the user-interface computer.

B1. An ergonomics awareness system comprising:

the ergonomics awareness chair of any of paragraphs A1-A22.2; and a user-interface computer that is programmed to display visual messages to a user of the ergonomics awareness chair;

wherein the controller of the ergonomics awareness chair and the user-interface computer are configured to wirelessly communicate with each other.

B2. The ergonomics awareness system of paragraph B1, wherein the user-interface computer is programmed to determine at least seven types of postures, based at least in part on the sensor values, and wherein the at least seven types of postures include slouching, hunching, straining shoulders, leaning, sitting on edge, crossing legs, and proper sitting posture.

B3. The ergonomics awareness system of any of paragraphs B1-B2, wherein the user-interface computer is programmed to indicate a slouching posture when the shoulder sensors sense a shoulder force, the buttocks sensors sense substantially no buttocks force, and the thigh sensors sense a thigh force, and optionally wherein the user-interface computer is programmed to indicate the slouching posture with a user alert.

B4. The ergonomics awareness system of any of paragraphs B1-B3, wherein the user-interface computer is programmed to indicate a hunching posture when the shoulder sensors sense substantially no shoulder force and at least one of the other sensors sense a body force, wherein the other sensors are the lumbar sensor, the buttocks sensors, the thigh sensors, and the armrest sensor of each armrest, and optionally wherein the user-interface computer is programmed to indicate the hunching posture with a user alert.

B5. The ergonomics awareness system of any of paragraphs B1-B4, wherein the user-interface computer is programmed to indicate a straining-shoulders posture when the shoulder sensors sense substantially no shoulder force, the armrest sensor in each armrest senses substantially no arm force, and at least one of the other sensors sense a body force, wherein the other sensors are the lumbar sensor, the buttocks sensors, and the thigh sensors, and optionally wherein the user-interface computer is programmed to indicate the straining-shoulders posture with a user alert.

B6. The ergonomics awareness system of any of paragraphs B1-B5, wherein the user-interface computer is programmed to indicate a leaning posture when the armrest sensor in each armrest senses a different arm force, and optionally wherein the user-interface computer is programmed to indicate the leaning posture with a user alert.

B7. The ergonomics awareness system of any of paragraphs B1-B6, wherein the user-interface computer is programmed to indicate a sitting-on-edge posture when the shoulder sensors sense substantially no shoulder force, the lumbar sensor senses substantially no lumbar force, the buttocks sensors sense substantially no buttocks force, and the thigh sensors sense a thigh force, and optionally wherein the user-interface computer is programmed to indicate the sitting-on-edge posture with a user alert.

B8. The ergonomics awareness system of any of paragraphs B1-B7, wherein the user-interface computer is programmed to indicate a crossing-legs posture when the buttocks sensors sense a buttocks force and the thigh sensors sense different thigh forces, and optionally wherein the user-interface computer is programmed to indicate the crossing-legs posture with a user alert.

B9. The ergonomics awareness system of any of paragraphs B1-B8, wherein the user-interface computer is programmed to indicate a proper sitting posture when the shoulder sensors sense a shoulder force, the lumbar sensor senses a lumbar force, the buttocks sensors sense a buttocks force, the thigh sensors sense a thigh force, and the armrest sensor in each armrest senses an arm force.

B10. The ergonomics awareness system of any of paragraphs B1-B9, wherein the user-interface computer is programmed to indicate a break after a threshold time in a proper sitting posture, and optionally wherein the user-interface computer is programmed to indicate the break with a user alert.

B11. The ergonomics awareness system of any of paragraphs B1-B10, wherein the user-interface computer is programmed to provide posture statistics to the user.

B11.1. The ergonomics awareness system of paragraph B11, wherein the posture statistics include statistics of at least one of user sitting postures, a daily summary of posture distribution, and a posture distribution over a user-defined time period.

B12. The ergonomics awareness system of any of paragraphs B1-B11.1, wherein the controller is configured to communicate the sensor values and/or calculated posture data to the user-interface computer.

B13. The ergonomics awareness system of any of paragraphs B1-B12, wherein the user-interface computer is programmed to record the sensor values and/or calculated posture data.

B14. The ergonomics awareness system of any of paragraphs B1-B13, wherein the ergonomics awareness chair and the user-interface computer are part of a user's workstation.

B15. The ergonomics awareness system of any of paragraphs B1-B14, wherein at least one of the controller and the user-interface computer is configured to suppress a posture alert based upon user input, and optionally is configured to suppress the posture alert for a predefined period of time.

B16. The ergonomics awareness system of any of paragraphs B1-B15, wherein at least one of the controller and the user-interface computer is configured to determine whether a sensor sensed a force by comparing the corresponding sensor value to a respective activity threshold, wherein the sensor is one of the shoulder sensors, the lumbar sensor, the buttocks sensors, the thigh sensors, and the armrest sensor, and wherein the force is a/the corresponding shoulder force, lumbar force, buttocks force, thigh force, or arm force.

B16.1. The ergonomics awareness system of paragraph B16, wherein at least one of the controller and the user-interface computer is configured to adjust the activity threshold for at least one of the sensors.

C1. A method of promoting ergonomic posture of a user sitting in a chair, optionally the ergonomics awareness chair of any of paragraphs A1-A22.2, the method comprising:

reading a first sensor value from a first sensor under a first chair pad of the chair and a second sensor value from a second sensor under a second chair pad of the chair;

calculating a posture type based at least in part on the first sensor value and the second sensor value, wherein the posture type is one of proper sitting posture and improper sitting posture;

determining a time the user has been continuously sitting correctly and, if the time is greater than a predetermined break interval, alerting the user to take a break from sitting in the chair;

alerting the user of improper posture when the posture type is at least one of the improper sitting posture and not the proper sitting posture; and repeating the reading, the calculating, the determining, and the alerting until the time is greater than the predetermined break interval.

C2. The method of paragraph C1, wherein the reading the first sensor value and the second sensor value is performed concurrently and/or within a defined time period that is less than 5 seconds, less than 2 seconds, or less than 1 second.

C3. The method of any of paragraphs C1-C2, wherein the second chair pad is the first chair pad.

C4. The method of any of paragraphs C1-C3, wherein the posture type of improper sitting posture includes slouching, hunching, straining shoulders, leaning, sitting on edge, and crossing legs.

C5. The method of any of paragraphs C1-C4, wherein the posture type is one of slouching, hunching, straining shoulders, leaning, sitting on edge, crossing legs, and proper sitting posture.

C6. The method of any of paragraphs C1-C5, wherein the calculating includes comparing the first sensor value to a first activity threshold and the second sensor value to a second activity threshold.

C7. The method of any of paragraphs C1-C6, wherein the calculating includes determining that the posture type is proper sitting posture when the first sensor value indicates activity and the second sensor value indicates activity.

C8. The method of any of paragraphs C1-C7, wherein the reading includes reading a right shoulder sensor value from a right shoulder sensor in a backrest of the chair, a left shoulder sensor value from a left shoulder sensor in the backrest of the chair, a lumbar sensor value from a lumbar sensor in the backrest of the chair, a right buttocks sensor value from a right buttocks sensor in a seat of the chair, a left buttocks sensor value from a left buttocks sensor in the seat of the chair, a right thigh sensor value from a right thigh sensor in the seat of the chair, a left thigh sensor value from a left thigh sensor in the seat of the chair, a right armrest sensor value from a right armrest sensor in a right armrest of the chair, and a left armrest sensor value from a left armrest sensor in a left armrest of the chair.

C8.1. The method of paragraph C8, wherein the reading the right shoulder sensor value, the left shoulder sensor value, the lumbar sensor value, the right buttocks sensor value, the left buttocks sensor value, the right thigh sensor value, the left thigh sensor value, the right armrest sensor value, and the left armrest sensor value is performed concurrently and/or within a defined time period that is less than 5 seconds, less than 2 seconds, or less than 1 second.

C8.2. The method of any of paragraphs C8-C8.1, wherein the calculating includes calculating the posture type based at least in part on at least two of the right shoulder sensor value, the left shoulder sensor value, the lumbar sensor value, the right buttocks sensor value, the left buttocks sensor value, the right thigh sensor value, the left thigh sensor value, the right armrest sensor value, and the left armrest sensor value.

C8.3. The method of any of paragraphs C8-C8.2, wherein calculating includes comparing the right shoulder sensor value to a right shoulder activity threshold, the left shoulder sensor value to a left shoulder activity threshold, the lumbar sensor value to a lumbar activity threshold, the right buttocks sensor value to a right buttocks activity threshold, the left buttocks sensor value to a left buttocks activity threshold, the right thigh sensor value to a right thigh activity threshold, the left thigh sensor value to a left thigh activity threshold, the right armrest sensor value to a right arm activity threshold, and the left armrest sensor value to a left arm activity threshold.

C8.4. The method of any of paragraphs C8-C8.3, wherein the calculating includes determining that the posture type is slouching when the right shoulder sensor value indicates activity, the left shoulder sensor value indicates activity, the right buttocks sensor value indicates inactivity, the left buttocks sensor value indicates inactivity, the right thigh sensor value indicates activity, and the left thigh sensor value indicates activity.

C8.5. The method of any of paragraphs C8-C8.4, wherein the calculating includes determining that the posture type is hunching when the right shoulder sensor value indicates inactivity, the left shoulder sensor value indicates inactivity, and at least one of the other sensor values indicates activity, wherein the other sensor values are the lumbar sensor value, the right buttocks sensor value, the left buttocks sensor value, the right thigh sensor value, the left thigh sensor value, the right armrest sensor value, and the left armrest sensor value.

C8.6. The method of any of paragraphs C8-C8.5, wherein the calculating includes determining that the posture type is straining shoulders when the right shoulder sensor value indicates inactivity, the left shoulder sensor value indicates inactivity, the right armrest sensor value indicates inactivity, the left armrest sensor value indicates inactivity, and at least one of the other sensor values indicates activity, wherein the other sensor values are the lumbar sensor value, the right buttocks sensor value, the left buttocks sensor value, the right thigh sensor value, and the left thigh sensor value.

C8.7. The method of any of paragraphs C8-C8.6, wherein the calculating includes determining that the posture type is leaning when the right armrest sensor value indicates a significantly different arm force than the left armrest sensor value.

C8.8. The method of any of paragraphs C8-C8.7, wherein the calculating includes determining that the posture type is sitting on edge when the right shoulder sensor value indicates inactivity, the left shoulder sensor value indicates inactivity, the lumbar sensor value indicates inactivity, the right buttocks sensor value indicates inactivity, the left buttocks sensor value indicates inactivity, the right thigh sensor value indicates activity, and the left thigh sensor value indicates activity.

C8.9. The method of any of paragraphs C8-C8.8, wherein the calculating includes determining that the posture type is crossing legs when the right buttocks sensor value indicates activity, the left buttocks sensor value indicates activity, and the right thigh sensor value indicates a significantly different thigh force than the left thigh sensor value.

C8.10. The method of any of paragraphs C8-C8.9, wherein the calculating includes determining that the posture type is proper sitting posture when the right shoulder sensor value indicates activity, the left shoulder sensor value indicates activity, the lumbar sensor value indicates activity, the right buttocks sensor value indicates activity, the left buttocks sensor value indicates activity, the right thigh sensor value indicates activity, the left thigh sensor value indicates activity, the right armrest sensor value indicates activity, and the left armrest sensor value indicates activity.

C9. The method of any of paragraphs C1-C8.10, wherein the phrase 'indicates activity' means indicates a corresponding force magnitude greater than or equal to a force threshold, and wherein the phrase 'indicates inactivity' means indicates a corresponding force magnitude less than the respective force threshold.

C10. The method of any of paragraphs C1-C9, wherein the repeating includes repeating the reading substantially periodically.

C11. The method of any of paragraphs C1-C10, wherein the alerting the user to take a break includes indicating a micro-break duration of less than 2 minutes, less than 1 minute, or less than 30 seconds.

C12. The method of any of paragraphs C1-C11, wherein the determining the time includes determining the time the user has been in the posture type, and wherein the alerting the user of improper posture includes alerting the user of improper posture if the posture type is the improper sitting posture and the time is greater than a predetermined threshold time.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, the phrases "at least one of" and "one or more of," in reference to a list of more than one entity, means any one or more of the entities in the list of entities, and is not limited to at least one of each and every entity specifically listed within the list of entities. For example, "at least one of A and B" (or, equivalently, "at least one of A or B," or, equivalently, "at least one of A and/or B") may refer to A alone, B alone, or the combination of A and B.

The various disclosed elements of systems and apparatuses and steps of methods disclosed herein are not required of all systems, apparatuses, and methods according to the present disclosure, and the present disclosure includes all novel and non-obvious combinations and subcombinations of the various elements and steps disclosed herein. Moreover, any of the various elements and steps, or any combination of the various elements and/or steps, disclosed herein may define independent inventive subject matter that is separate and apart from the whole of a disclosed system, apparatus, or method. Accordingly, such inventive subject matter is not required to be associated with the specific systems, apparatuses, and methods that are expressly disclosed herein, and such inventive subject matter may find utility in systems, apparatuses, and/or methods that are not expressly disclosed herein.

The invention claimed is:

1. A method of promoting ergonomic posture of a user sitting in an ergonomics awareness chair, the method comprising:

reading a first sensor value from a first sensor of the ergonomics awareness chair and a second sensor value from a second sensor of the ergonomics awareness chair;

calculating a posture type based on the first sensor value and the second sensor value, wherein the posture type is one of proper sitting posture and improper sitting posture;

determining a time the user has been in the posture type; and alerting the user that one of: the posture type is the improper sitting posture and the time is greater than a predetermined threshold time, or the posture type is the proper sitting posture and the time is greater than a predetermined break interval.

2. The method of claim 1, wherein the ergonomics awareness chair includes a seat, a backrest, a right armrest, and a left armrest, wherein the first sensor is in one of the seat, the backrest, the right armrest, and the left armrest, and wherein the second sensor is in one of the seat, the backrest, the right armrest, and the left armrest.

3. The method of claim 1, wherein the reading the first sensor value and the second sensor value is performed concurrently.

4. The method of claim 1, wherein the reading is performed over time.

5. The method of claim 1, wherein the alerting the user includes alerting the user to take a micro-break of duration of less than 1 minute.

6. A method of promoting ergonomic posture of a user sitting in an ergonomics awareness chair, the method comprising:

reading a right shoulder sensor value from a right shoulder sensor in a backrest of the ergonomics awareness chair, a left shoulder sensor value from a left shoulder sensor in the backrest, a lumbar sensor value from a lumbar sensor in the backrest, a right buttocks sensor value from a right buttocks sensor in a seat of the ergonomics awareness chair, a left buttocks sensor value from a left buttocks sensor in the seat, a right thigh sensor value from a right thigh sensor in the seat, a left thigh sensor value from a left thigh sensor in the seat, a right armrest sensor value from a right armrest sensor in a right armrest of the ergonomics awareness chair, and a left armrest sensor value from a left armrest sensor in a left armrest of the ergonomics awareness chair;

calculating a posture type based on at least two values selected from the group consisting of the right shoulder sensor value, the left shoulder sensor value, the lumbar sensor value, the right buttocks sensor value, the left buttocks sensor value, the right thigh sensor value, the left thigh sensor value, the right armrest sensor value, and the left armrest sensor value, wherein the posture type is one of slouching, hunching, straining shoulders, leaning, sitting on edge, crossing legs, and proper sitting posture;

determining a time the user has been continuously sitting in the proper sitting posture and, if the time is greater than a predetermined threshold time, alerting the user to take a break;

alerting the user when the posture type is an improper sitting posture selected from the group consisting of slouching, hunching, straining shoulders, leaning, sitting on edge, and crossing legs; and repeating the reading, the calculating, the determining, and the alerting until the time is greater than the predetermined threshold time.

7. The method of claim 6, wherein the reading the right shoulder sensor value, the left shoulder sensor value, the lumbar sensor value, the right buttocks sensor value, the left buttocks sensor value, the right thigh sensor value, the left thigh sensor value, the right armrest sensor value, and the left armrest sensor value is performed within a defined time period that is less than 1 second.

8. The method of claim 6, wherein calculating includes comparing the right shoulder sensor value to a right shoulder activity threshold, the left shoulder sensor value to a left shoulder activity threshold, the lumbar sensor value to a lumbar activity threshold, the right buttocks sensor value to a right buttocks activity threshold, the left buttocks sensor value to a left buttocks activity threshold, the right thigh sensor value to a right thigh activity threshold, the left thigh sensor value to a left thigh activity threshold, the right armrest sensor value to a right arm activity threshold, and the left armrest sensor value to a left arm activity threshold.

9. The method of claim 6, wherein the calculating includes determining that the posture type is slouching when the right shoulder sensor value indicates activity, the left shoulder sensor value indicates activity, the right buttocks sensor value indicates inactivity, the left buttocks sensor value indicates inactivity, the right thigh sensor value indicates activity, and the left thigh sensor value indicates activity.

10. The method of claim 6, wherein the calculating includes determining that the posture type is hunching when the right shoulder sensor value indicates inactivity, the left shoulder sensor value indicates inactivity, and another sensor value indicates activity, wherein the another sensor value is selected from the group consisting of the lumbar sensor value, the right buttocks sensor value, the left buttocks sensor value, the right thigh sensor value, the left thigh sensor value, the right armrest sensor value, and the left armrest sensor value.

11. The method of claim 6, wherein the calculating includes determining that the posture type is straining shoulders when the right shoulder sensor value indicates inactivity, the left shoulder sensor value indicates inactivity, the right armrest sensor value indicates inactivity, the left armrest sensor value indicates inactivity, and another sensor value indicates activity, wherein the another sensor value is selected from the group consisting of the lumbar sensor value, the right buttocks sensor value, the left buttocks sensor value, the right thigh sensor value, and the left thigh sensor value.

12. The method of claim 6, wherein the calculating includes determining that the posture type is leaning when the right armrest sensor value indicates a significantly different arm force than the left armrest sensor value.

13. The method of claim 6, wherein the calculating includes determining that the posture type is sitting on edge when the right shoulder sensor value indicates inactivity, the left shoulder sensor value indicates inactivity, the lumbar sensor value indicates inactivity, the right buttocks sensor value indicates inactivity, the left buttocks sensor value indicates inactivity, the right thigh sensor value indicates activity, and the left thigh sensor value indicates activity.

14. The method of claim 6, wherein the calculating includes determining that the posture type is crossing legs when the right buttocks sensor value indicates activity, the left buttocks sensor value indicates activity, and the right thigh sensor value indicates a significantly different thigh force than the left thigh sensor value.

15. The method of claim 6, wherein the calculating includes determining that the posture type is proper sitting posture when the right shoulder sensor value indicates activity, the left shoulder sensor value indicates activity, the lumbar sensor value indicates activity, the right buttocks sensor value indicates activity, the left buttocks sensor value indicates activity, the right thigh sensor value indicates activity, the left thigh sensor value indicates activity, the right armrest sensor value indicates activity, and the left armrest sensor value indicates activity.

16. An ergonomics awareness system comprising:

an ergonomics awareness chair that includes:

a chair including a seat, a seat support, a backrest, and two armrests;

one or more shoulder sensors in the backrest, wherein each shoulder sensor is configured to sense force from a user's shoulder against the backrest;

a lumbar sensor in the backrest, wherein the lumbar sensor is configured to sense force from a user's lumbar region against the backrest;

one or more buttocks sensors in the seat, wherein each buttocks sensor is configured to sense force from a user's buttocks on the seat;

one or more thigh sensors in the seat, wherein each thigh sensor is configured to sense force from a user's thigh on the seat;

a single armrest sensor in each armrest, wherein each armrest sensor is configured to sense force from a user's arm on the respective armrest; and a controller configured to acquire sensor values from the shoulder sensors, the lumbar sensor, the buttocks sensors, the thigh sensors, and the armrest sensor of each armrest; and a user-interface computer that is programmed to display visual messages to a user of the ergonomics awareness chair, wherein the user-interface computer is programmed to determine at least two types of postures, based at least in part on the sensor values, and wherein the at least two types of postures include improper sitting posture and proper sitting posture;

wherein the controller of the ergonomics awareness chair and the user-interface computer are configured to wirelessly communicate with each other.

17. The ergonomics awareness system of claim 16, wherein improper sitting posture includes at least one of slouching, hunching, straining shoulders, leaning, sitting on edge and crossing legs.

18. The ergonomics awareness system of claim 16, wherein the ergonomics awareness chair includes two shoulder sensors, wherein a right shoulder sensor is configured to sense force from a user's right shoulder and a left shoulder sensor is configured to sense force from a user's left shoulder, wherein the ergonomics awareness chair includes a single lumbar sensor, wherein the ergonomics awareness chair includes two buttocks sensors, wherein a right buttocks sensor is configured to sense force from a user's right buttock and a left buttocks sensor is configured to sense force from a user's left buttocks, wherein the ergonomics awareness chair includes two thigh sensors, wherein a right thigh sensor is configured to sense force from a user's right thigh and a left thigh sensor is configured to sense force from a user's left thigh, and wherein the ergonomics awareness chair includes a right armrest with a single right armrest sensor and a left armrest with a single left armrest sensor, wherein the right armrest is configured to support a user's right arm, the right armrest sensor is configured to sense force from the user's right arm, the left armrest is configured to support a user's left arm, and the left armrest sensor is configured to sense force from the user's left arm.

19. The ergonomics awareness system of claim 16, wherein the ergonomics awareness chair and the user-interface computer are part of a user's workstation.

20. The ergonomics awareness system of claim 16, wherein each sensor is coupled to a force enhancer.

* * * * *